US008467543B2

(12) United States Patent
Burnett et al.

(10) Patent No.: US 8,467,543 B2
(45) **Date of Patent: *Jun. 18, 2013**

(54) MICROPHONE AND VOICE ACTIVITY DETECTION (VAD) CONFIGURATIONS FOR USE WITH COMMUNICATION SYSTEMS

(75) Inventors: Gregory C. Burnett, Livermore, CA (US); Nicolas J. Petit, San Francisco, CA (US); Alexander M. Asseily, San Francisco, CA (US); Andrew E. Einaudi, San Francisco, CA (US)

(73) Assignee: AliphCom, San Francisco, CA (US)

( * ) Notice: Subject to any disclaimer, the term of this patent is extended or adjusted under 35 U.S.C. 154(b) by 977 days.

This patent is subject to a terminal disclaimer.

(21) Appl. No.: 10/400,282

(22) Filed: Mar. 27, 2003

(65) Prior Publication Data

US 2003/0228023 A1 Dec. 11, 2003

Related U.S. Application Data

(60) Provisional application No. 60/368,209, filed on Mar. 27, 2002.

(51) Int. Cl.
*H04B 15/00* (2006.01)

(52) U.S. Cl.
USPC ..... 381/94.1; 381/92; 381/94.3; 381/94.7; 704/226; 704/233

(58) Field of Classification Search
USPC ..... 381/94.7, 71.6, 110, 71.7, 111, 11, 381/91–92, 94.1–94.3; 704/226, 233
See application file for complete search history.

(56) References Cited

U.S. PATENT DOCUMENTS 3,789,166 A 1/1974 Sebesta
4,006,318 A 2/1977 Sebesta et al.

(Continued)

FOREIGN PATENT DOCUMENTS

EP 0 637 187 A 2/1995
EP 0 795 851 A2 9/1997

(Continued)

OTHER PUBLICATIONS

Zhao Li et al: "Robust Speech Coding Using Microphone Arrays", Signals Systems and Computers, 1997. Conf. record of 31st Asilomar Conf., Nov. 2-5, 1997, IEEE Comput. Soc. Nov. 2, 1997. USA.

(Continued)

*Primary Examiner* — Disler Paul
(74) *Attorney, Agent, or Firm* — Kokka & Backus, PC

(57) ABSTRACT

Communication systems are described, including both portable handset and headset devices, which use a number of microphone configurations to receive acoustic signals of an environment. The microphone configurations include, for example, a two-microphone array including two unidirectional microphones, and a two-microphone array including one unidirectional microphone and one omnidirectional microphone. The communication systems also include Voice Activity Detection (VAD) devices to provide information of human voicing activity. Components of the communications systems receive the acoustic signals and voice activity signals and, in response, automatically generate control signals from data of the voice activity signals. Components of the communication systems use the control signals to automatically select a denoising method appropriate to data of frequency subbands of the acoustic signals. The selected denoising method is applied to the acoustic signals to generate denoised acoustic signals when the acoustic signal includes speech and noise.

26 Claims, 29 Drawing Sheets

U.S. PATENT DOCUMENTS

| | | | | | |
|---|---|---|---|---|---|
| 4,591,668 | A | | 5/1986 | Iwata | |
| 4,901,354 | A | | 2/1990 | Gollmar et al. | |
| 5,097,515 | A | | 3/1992 | Baba | |
| 5,212,764 | A | | 5/1993 | Ariyoshi | |
| 5,353,376 | A | * | 10/1994 | Oh et al. | 704/233 |
| 5,400,409 | A | | 3/1995 | Linhard | |
| 5,406,622 | A | | 4/1995 | Silverberg et al. | |
| 5,414,776 | A | | 5/1995 | Sims, Jr. | |
| 5,473,702 | A | * | 12/1995 | Yoshida et al. | 381/94.7 |
| 5,515,865 | A | | 5/1996 | Scanlon et al. | |
| 5,517,435 | A | | 5/1996 | Sugiyama | |
| 5,539,859 | A | | 7/1996 | Robbe et al. | |
| 5,590,241 | A | * | 12/1996 | Park et al. | 704/227 |
| 5,625,684 | A | * | 4/1997 | Matouk et al. | 379/392.01 |
| 5,633,935 | A | | 5/1997 | Kanamori et al. | |
| 5,649,055 | A | | 7/1997 | Gupta et al. | |
| 5,684,460 | A | | 11/1997 | Scanlon et al. | |
| 5,729,694 | A | | 3/1998 | Holzrichter et al. | |
| 5,754,665 | A | | 5/1998 | Hosoi et al. | |
| 5,835,608 | A | | 11/1998 | Warnaka et al. | |
| 5,853,005 | A | | 12/1998 | Scanlon | |
| 5,917,921 | A | | 6/1999 | Sasaki et al. | |
| 5,966,090 | A | | 10/1999 | McEwan | |
| 5,986,600 | A | | 11/1999 | McEwan | |
| 6,006,175 | A | | 12/1999 | Holzrichter | |
| 6,009,396 | A | | 12/1999 | Nagata | |
| 6,069,963 | A | | 5/2000 | Martin et al. | |
| 6,191,724 | B1 | | 2/2001 | McEwan | |
| 6,266,422 | B1 | | 7/2001 | Ikeda | |
| 6,430,295 | B1 | | 8/2002 | Handel et al. | |
| 6,795,713 | B2 | * | 9/2004 | Housni | 455/550.1 |
| 6,963,649 | B2 | * | 11/2005 | Vaudrey et al. | 381/94.7 |
| 6,980,092 | B2 | * | 12/2005 | Turnbull et al. | 340/425.5 |
| 7,206,418 | B2 | * | 4/2007 | Yang et al. | 381/92 |
| 2002/0039425 | A1 | | 4/2002 | Burnett et al. | |
| 2003/0044025 | A1 | * | 3/2003 | Ouyang et al. | 381/92 |
| 2003/0130839 | A1 | * | 7/2003 | Beaucoup et al. | 704/226 |

FOREIGN PATENT DOCUMENTS

| | | |
|---|---|---|
| EP | 0 984 660 A2 | 3/2000 |
| JP | 2000 312 395 | 11/2000 |
| JP | 2001 189 987 | 7/2001 |
| WO | WO 02 07151 | 1/2002 |

OTHER PUBLICATIONS

L.C. Ng et al.: "Denoising of Human Speech Using Combined Acoustic and EM Sensor Signal Processing", 2000 IEEE Intl Conf on Acoustics Speech and Signal Processing. Proceedings (Cat. No. 00CH37100), Istanbul, Turkey, Jun. 5-9, 2000 XP002186255, ISBN 0-7803-6293-4.

S. Affes et al.: "A Signal Subspace Tracking Algorithm for Microphone Array Processing of Speech". IEEE Transactions on Speech and Audio Processing, N.Y, USA vol. 5, No. 5, Sep. 1, 1997. XP000774303. ISBN 1063-6676.

Gregory C. Burnett: "The Physiological Basis of Glottal Electromagnetic Micropower Sensors (GEMS) and Their Use in Defining an Excitation Function for the Human Vocal Tract", Dissertation. University of California at Davis. Jan. 1999. USA.

Todd J. Gable et al.: "Speaker Verification Using Combined Acoustic and EM Sensor Signal Processing", ICASSP-2001, Salt Lake City, USA.

A. Hussain: "Intelligibility Assessment of a Multi-Band Speech Enhancement Scheme", Proceedings IEEE Intl. Conf. on Acoustics, Speech & Signal Processing (ICASSP-2000). Istanbul, Turkey. Jun. 2000.

* cited by examiner

UNIDIRECTIONAL

| Characteristic | Omni-Directional | Cardioid | Super-Cardioid | Hyper-Cardioid | Bi-Directional |
|---|---|---|---|---|---|
| Polar Response Pattern | | | | | |
| Coverage Angle | 360° | 131° | 115° | 105° | 90° |
| Angle of Maximum Rejection (null angle) | — | 180° | 126° | 110° | 90° |
| Rear Rejection (relative to front) | 0 | 25 dB | 12 dB | 6 dB | 0 |
| Ambient Sound Sensitivity (relative to omni) | 100% | 33% | 27% | 25% | 33% |
| Distance Factor (relative to omni) | 1 | 1.7 | 1.9 | 2 | 1.7 |

FIG.2
(PRIOR ART)

MICROPHONE AND VOICE ACTIVITY DETECTION (VAD) CONFIGURATIONS FOR USE WITH COMMUNICATION SYSTEMS

RELATED APPLICATIONS

This application claims priority from U.S. Patent Application No. 60/368,209, entitled MICROPHONE AND VOICE ACTIVITY DETECTION (VAD) CONFIGURATIONS FOR USE WITH PORTABLE COMMUNICATION SYSTEMS, filed Mar. 27, 2002.

Further, this application relates to the following U.S. Patent Applications: Application Ser. No. 09/905,361, entitled METHOD AND APPARATUS FOR REMOVING NOISE FROM ELECTRONIC SIGNALS, filed Jul. 12, 2001; application Ser. No. 10/159,770, entitled DETECTING VOICED AND UNVOICED SPEECH USING BOTH ACOUSTIC AND NONACOUSTIC SENSORS, filed May 30, 2002; application Ser. No. 10/301,237, entitled METHOD AND APPARATUS FOR REMOVING NOISE FROM ELECTRONIC SIGNALS, filed Nov. 21, 2002; and application Ser. No. 10/383,162, entitled VOICE ACTIVITY DETECTION (VAD) DEVICES AND METHODS FOR USE WITH NOISE SUPPRESSION SYSTEMS, filed Mar. 5, 2003.

TECHNICAL FIELD

The disclosed embodiments relate to systems and methods for detecting and processing a desired acoustic signal in the presence of acoustic noise.

BACKGROUND

Many noise suppression algorithms and techniques have been developed over the years. Most of the noise suppression systems in use today for speech communication systems are based on a single-microphone spectral subtraction technique first develop in the 1970's and described, for example, by S. F. Boll in "Suppression of Acoustic Noise in Speech using Spectral Subtraction," IEEE Trans. on ASSP, pp. 113-120, 1979. These techniques have been refined over the years, but the basic principles of operation have remained the same. See, for example, U.S. Pat. No. 5,687,243 of McLaughlin, et al., and U.S. Pat. No. 4,811,404 of Vilmur, et al. Generally, these techniques make use of a single-microphone Voice Activity Detector (VAD) to determine the background noise characteristics, where "voice" is generally understood to include human voiced speech, unvoiced speech, or a combination of voiced and unvoiced speech.

The VAD has also been used in digital cellular systems. As an example of such a use, see U.S. Pat. No. 6,453,291 of Ashley, where a VAD configuration appropriate to the front-end of a digital cellular system is described. Further, some Code Division Multiple Access (CDMA) systems utilize a VAD to minimize the effective radio spectrum used, thereby allowing for more system capacity. Also, Global System for Mobile Communication (GSM) systems can include a VAD to reduce co-channel interference and to reduce battery consumption on the client or subscriber device.

These typical single-microphone VAD systems are significantly limited in capability as a result of the analysis of acoustic information received by the single microphone, wherein the analysis is performed using typical signal processing techniques. In particular, limitations in performance of these single-microphone VAD systems are noted when processing signals having a low signal-to-noise ratio (SNR), and in settings where the background noise varies quickly.

Thus, similar limitations are found in noise suppression systems using these single-microphone VADs.

Many limitations of these typical single-microphone VAD systems were overcome with the introduction of the Pathfinder noise suppression system by Aliph of San Francisco, Calif. (http://www.aliph.com), described in detail in the Related Applications. The Pathfinder noise suppression system differs from typical noise cancellation systems in several important ways. For example, it uses an accurate voiced activity detection (VAD) signal along with two or more microphones, where the microphones detect a mix of both noise and speech signals. While the Pathfinder noise suppression system can be used with and integrated in a number of communication systems and signal processing systems, so can a variety of devices and/or methods be used to supply the VAD signal. Further, a number of microphone types and configurations can be used to provide acoustic signal information to the Pathfinder system.

BRIEF DESCRIPTION OF THE FIGURES

FIG. 2 is a table describing different types of microphones and the associated spatial responses in the prior art.

Figure 1:
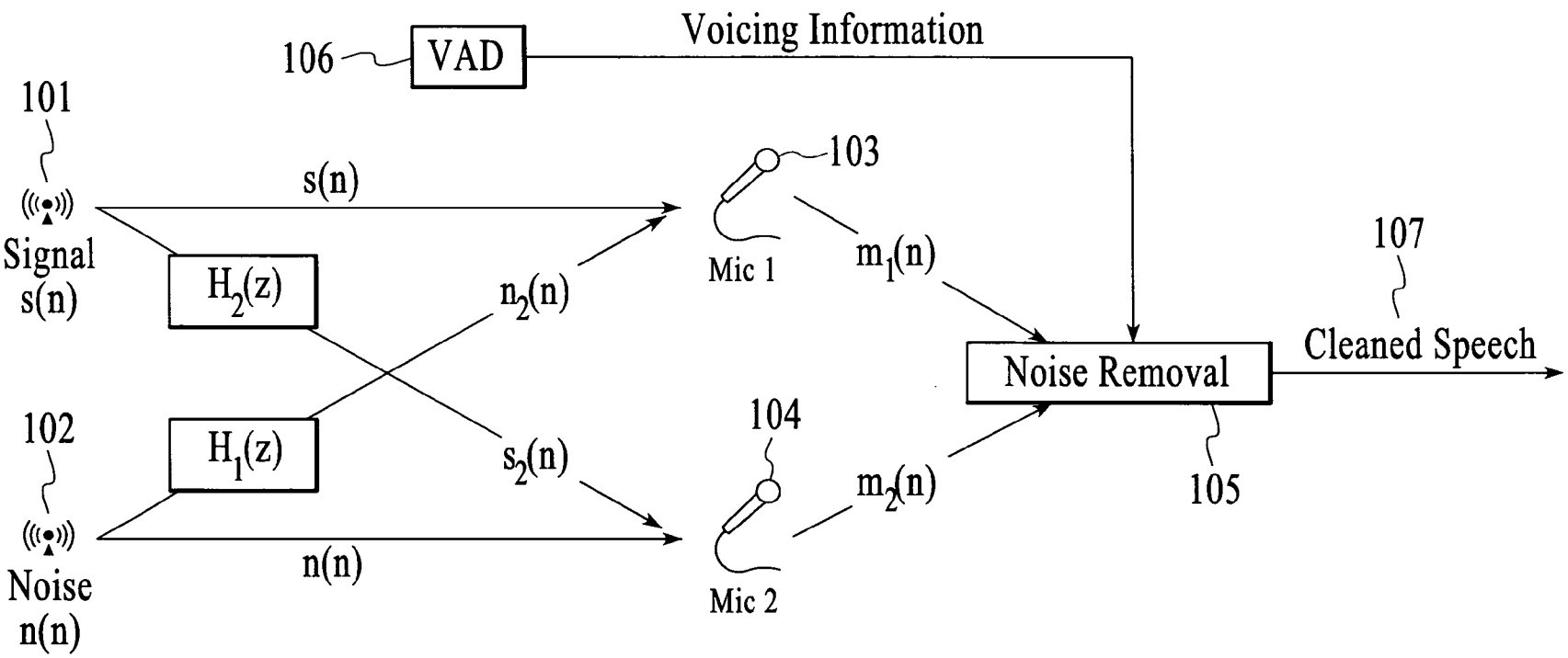
FIG. 1 is a block diagram of a signal processing system including the Pathfinder noise removal or suppression system and a VAD system, under an embodiment.

In the drawings, the same reference numbers identify identical or substantially similar elements or acts. To easily identify the discussion of any particular element or act, the most significant digit or digits in a reference number refer to the Figure number in which that element is first introduced (e.g., element 105 is first introduced and discussed with respect to FIG. 1).

The headings provided herein are for convenience only and do not necessarily affect the scope or meaning of the claimed invention. The following description provides specific details for a thorough understanding of, and enabling description for, embodiments of the invention. However, one skilled in the art will understand that the invention may be practiced without these details. In other instances, well-known structures and functions have not been shown or described in detail to avoid unnecessarily obscuring the description of the embodiments of the invention.

DETAILED DESCRIPTION

Numerous communication systems are described below, including both handset and headset devices, which use a variety of microphone configurations to receive acoustic signals of an environment. The microphone configurations include, for example, a two-microphone array including two unidirectional microphones, and a two-microphone array including one unidirectional microphone and one omnidirectional microphone, but are not so limited. The communication systems can also include Voice Activity Detection (VAD) devices to provide voice activity signals that include information of human voicing activity. Components of the communications systems receive the acoustic signals and voice activity signals and, in response, automatically generate control signals from data of the voice activity signals. Components of the communication systems use the control signals to automatically select a denoising method appropriate to data of frequency subbands of the acoustic signals. The selected denoising method is applied to the acoustic signals to generate denoised acoustic signals when the acoustic signals include speech and noise.

Numerous microphone configurations are described below for use with the Pathfinder noise suppression system. As such, each configuration is described in detail along with a method of use to reduce noise transmission in communication devices, in the context of the Pathfinder system. When the Pathfinder noise suppression system is referred to, it should be kept in mind that noise suppression systems that estimate the noise waveform and subtract it from a signal and that use or are capable of using the disclosed microphone configurations and VAD information for reliable operation are included in that reference. Pathfinder is simply a convenient referenced implementation for a system that operates on signals comprising desired speech signals along with noise. Thus, the use of these physical microphone configurations includes but is not limited to applications such as communications, speech recognition, and voice-feature control of applications and/or devices.

The terms "speech" or "voice" as used herein generally refer to voiced, unvoiced, or mixed voiced and unvoiced human speech. Unvoiced speech or voiced speech is distinguished where necessary. However, the term "speech signal" or "speech", when used as a converse to noise, simply refers to any desired portion of a signal and does not necessarily have to be human speech. It could, as an example, be music or some other type of desired acoustic information. As used in the Figures, "speech" is meant to mean any signal of interest, whether human speech, music, or anything other signal that it is desired to hear.

In the same manner, "noise" refers to unwanted acoustic information that distorts a desired speech signal or makes it more difficult to comprehend. "Noise suppression" generally describes any method by which noise is reduced or eliminated in an electronic signal.

Moreover, the term "VAD" is generally defined as a vector or array signal, data, or information that in some manner represents the occurrence of speech in the digital or analog domain. A common representation of VAD information is a one-bit digital signal sampled at the same rate as the corresponding acoustic signals, with a zero value representing that no speech has occurred during the corresponding time sample, and a unity value indicating that speech has occurred during the corresponding time sample. While the embodiments described herein are generally described in the digital domain, the descriptions are also valid for the analog domain.

The term "Pathfinder", unless otherwise specified, denotes any denoising system using two or more microphones, a VAD device and algorithm, and which estimates the noise in a signal and subtracts it from that signal. The Aliph Pathfinder system is simply a convenient reference for this type of denoising system, although it is more capable than the above definition. In some cases (such as the microphone arrays described in FIGS. 8 and 9), the "full capabilities" or "full version" of the Aliph Pathfinder system are used (as there is a significant amount of speech energy in the noise microphone), and these cases will be enumerated in the text. "Full capabilities" indicates the use of both $H_1(z)$ and $H_2(z)$ by the Pathfinder system in denoising the signal. Unless otherwise specified, it is assumed that only $H_1(z)$ is used to denoise the signal.

The Pathfinder system is a digital signal processing—(DSP) based acoustic noise suppression and echo-cancellation system. The Pathfinder system, which can couple to the front-end of speech processing systems, uses VAD information and received acoustic information to reduce or eliminate noise in desired acoustic signals by estimating the noise waveform and subtracting it from a signal including both speech and noise. The Pathfinder system is described further below and in the Related Applications.

FIG. 1 is a block diagram of a signal processing system 100 including the Pathfinder noise removal or suppression system 105 and a VAD system 106, under an embodiment. The signal processing system 100 includes two microphones MIC 1 103 and MIC 2 104 that receive signals or information from at least one speech signal source 101 and at least one noise source 102. The path s(n) from the speech signal source 101 to MIC 1 and the path n(n) from the noise source 102 to MIC 2 are considered to be unity. Further, $H_1(z)$ represents the path from the noise source 102 to MIC 1, and $H_2(z)$ represents the path from the speech signal source 101 to MIC 2.

Components of the signal processing system 100, for example the noise removal system 105, couple to the microphones MIC 1 and MIC 2 via wireless couplings, wired couplings, and/or a combination of wireless and wired couplings. Likewise, the VAD system 106 couples to components of the signal processing system 100, like the noise removal system 105, via wireless couplings, wired couplings, and/or a combination of wireless and wired couplings. As an example, the VAD devices and microphones described below as components of the VAD system 106 can comply with the Bluetooth wireless specification for wireless communication with other components of the signal processing system, but are not so limited.

Figure 1A:
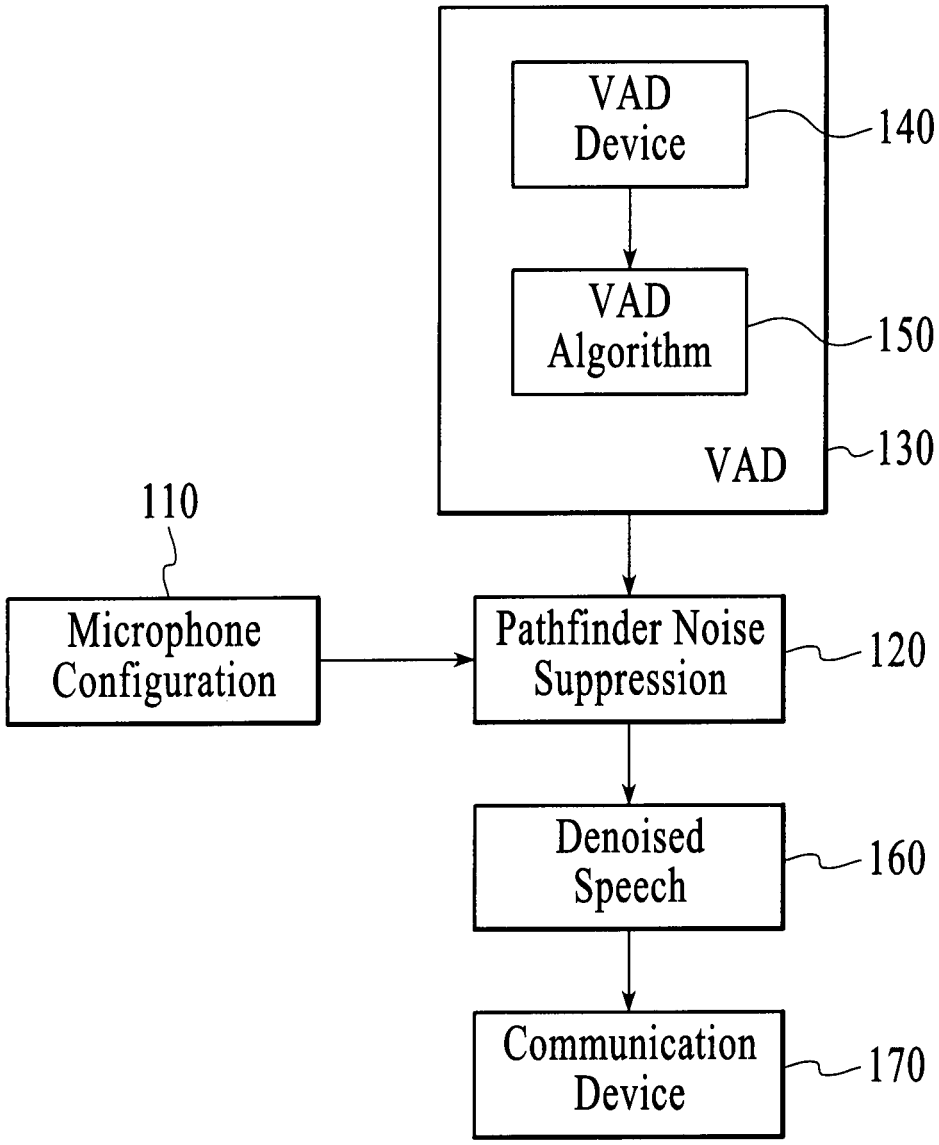
FIG. 1A is a block diagram of a noise suppression/communication system including hardware for use in receiving and processing signals relating to VAD, and utilizing specific microphone configurations, under the embodiment of FIG. 1.

FIG. 1A is a block diagram of a noise suppression/communication system including hardware for use in receiving and processing signals relating to VAD, and utilizing specific microphone configurations, under an embodiment. Referring to FIG. 1A, each of the embodiments described below includes at least two microphones in a specific configuration 110 and one voiced activity detection (VAD) system 130, which includes both a VAD device 140 and a VAD algorithm 150, as described in the Related Applications. Note that in some embodiments the microphone configuration 110 and the VAD device 140 incorporate the same physical hardware, but they are not so limited. Both the microphones 110 and the VAD 130 input information into the Pathfinder noise suppression system 120 which uses the received information to denoise the information in the microphones and output denoised speech 160 into a communications device 170.

The communications device 170 includes both handset and headset communication devices, but is not so limited. Handsets or handset communication devices include, but are not limited to, portable communication devices that include microphones, speakers, communications electronics and electronic transceivers, such as cellular telephones, portable or mobile telephones, satellite telephones, wireline telephones, Internet telephones, wireless transceivers, wireless communication radios, personal digital assistants (PDAs), and personal computers (PCs).

Headset or headset communication devices include, but are not limited to, self-contained devices including microphones and speakers generally attached to and/or worn on the body. Headsets often function with handsets via couplings with the handsets, where the couplings can be wired, wireless, or a combination of wired and wireless connections. However, the headsets can communicate independently with components of a communications network.

The VAD device 140 includes, but is not limited to, accelerometers, skin surface microphones (SSMs), and electromagnetic devices, along with the associated software or algorithms. Further, the VAD device 140 includes acoustic microphones along with the associated software. The VAD devices and associated software are described in U.S. patent application Ser. No. 10/383,162, entitled VOICE ACTIVITY DETECTION (VAD) DEVICES AND METHODS FOR USE WITH NOISE SUPPRESSION SYSTEMS, filed Mar. 5, 2003.

The configurations described below of each handset/headset design include the location and orientation of the microphones and the method used to obtain a reliable VAD signal. All other components (including the speaker and mounting hardware for headsets and the speaker, buttons, plugs, physical hardware, etc. for the handsets) are inconsequential for the operation of the Pathfinder noise suppression algorithm and will not be discussed in great detail, with the exception of the mounting of unidirectional microphones in the handset or headset. The mounting is described to provide information for the proper ventilation of the directional microphones. Those familiar with the state of the art will not have difficulty mounting the unidirectional microphones correctly given the placement and orientation information in this application.

Furthermore, the method of coupling (either physical or electromagnetic or otherwise) of the headsets described below is inconsequential. The headsets described work with any type of coupling, so they are not specified in this disclosure. Finally, the microphone configuration 110 and the VAD 130 are independent, so that any microphone configuration can work with any VAD device/method, unless it is desired to use the same microphones for both the VAD and the microphone configuration. In this case the VAD can place certain requirements on the microphone configuration. These exceptions are noted in the text.

Microphone Configurations

The Pathfinder system, although using particular microphone types (omnidirectional or unidirectional, including the amount of unidirectionality) and microphone orientations, is not sensitive to the typical distribution of responses of individual microphones of a given type. Thus the microphones do not need to be matched in terms of frequency response nor do they need to be especially sensitive or expensive. In fact, configurations described herein have been constructed using inexpensive off-the-shelf microphones, which have proven to be very effective. As an aid to review, the Pathfinder setup is shown in FIG. 1 and is explained in detail below and in the Related Applications. The relative placement and orientation of the microphones in the Pathfinder system is described herein. Unlike classical adaptive noise cancellation (ANC), which specifies that there can be no speech signal in the noise microphone, Pathfinder allows speech signal to be present in both microphones which means the microphones can be placed very close together, as long as the configurations in the following section are used. Following is a description of the microphone configurations used to implement the Pathfinder noise suppression system.

There are many different types of microphones in use today, but generally speaking, there are two main categories:

omnidirectional (referred to herein as "OMNI microphones" or "OMNI") and unidirectional (referred to herein as "UNI microphones" or "UNI"). The OMNI microphones are characterized by relatively consistent spatial response with respect to relative acoustic signal location, and UNI microphones are characterized by responses that vary with respect to the relative orientation of the acoustic source and the microphone. Specifically, the UNI microphones are normally designed to be less responsive behind and to the sides of the microphone so that signals from the front of the microphone are emphasized relative to those from the sides and rear.

There are several types of UNI microphones (although really only one type of OMNI) and the types are differentiated by the microphone's spatial response. FIG. 2 is a table describing different types of microphones and the associated spatial responses (from the Shure microphone company website at http://www.shure.com). It has been found that both cardioid and super-cardioid unidirectional microphones work well in the embodiments described herein, but hyper-cardioid and bi-directional microphones may also be used. Also, "close-talk" (or gradient) microphones (which de-emphasize acoustic sources more than a few centimeters away from the microphone) can be used as the speech microphone, and for this reason the close-talk microphone is considered in this disclosure as a UNI microphone.

Microphone Arrays Including Mixed OMNI and UNI Microphones

In an embodiment, an OMNI and UNI microphone are mixed to form a two-microphone array for use with the Pathfinder system. The two-microphone array includes combinations where the UNI microphone is the speech microphone and combinations in which the OMNI microphone is the speech microphone, but is not so limited.

UNI Microphone as Speech Microphone

Figure 3A:
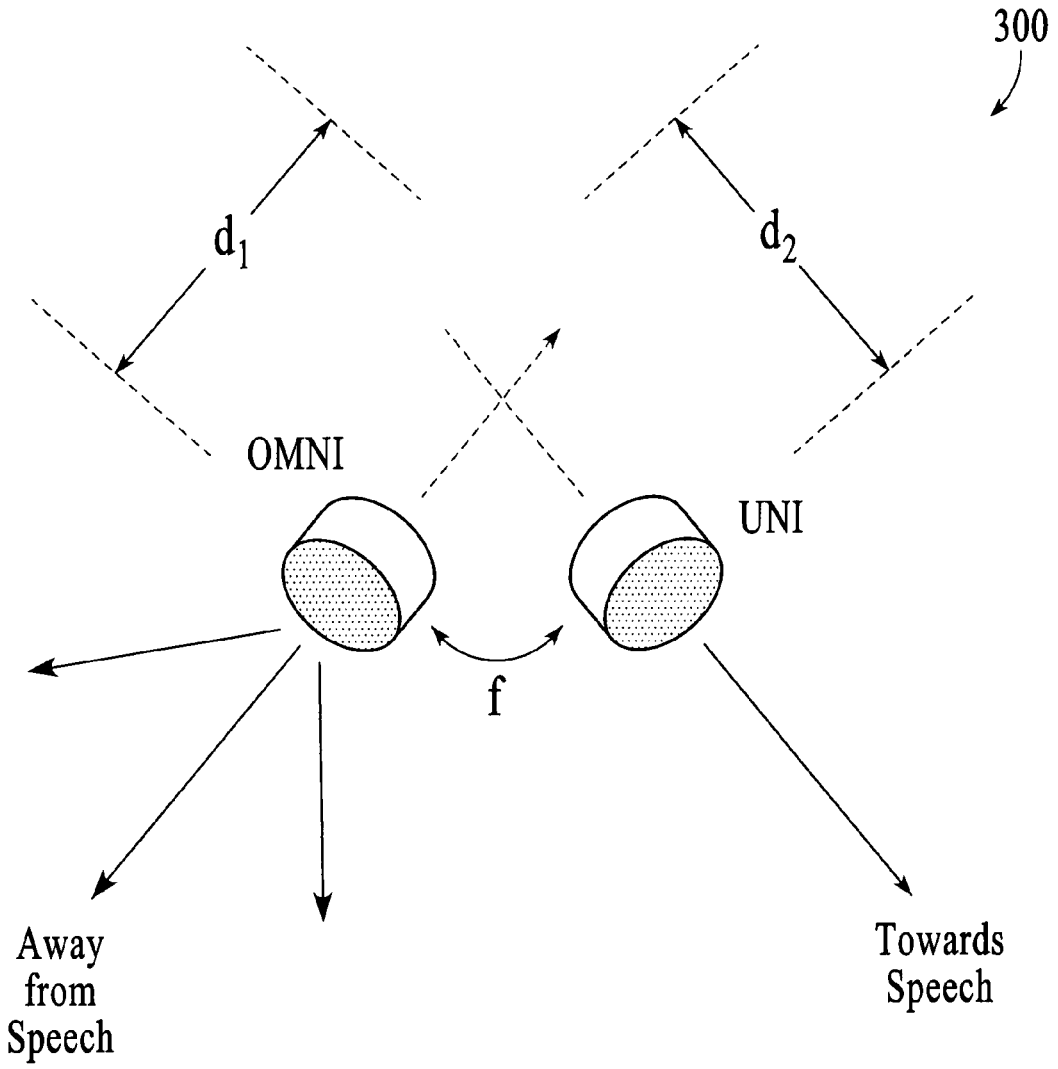
FIG. 3A shows a microphone configuration using a unidirectional speech microphone and an omnidirectional noise microphone, under an embodiment.
Figure 3B:
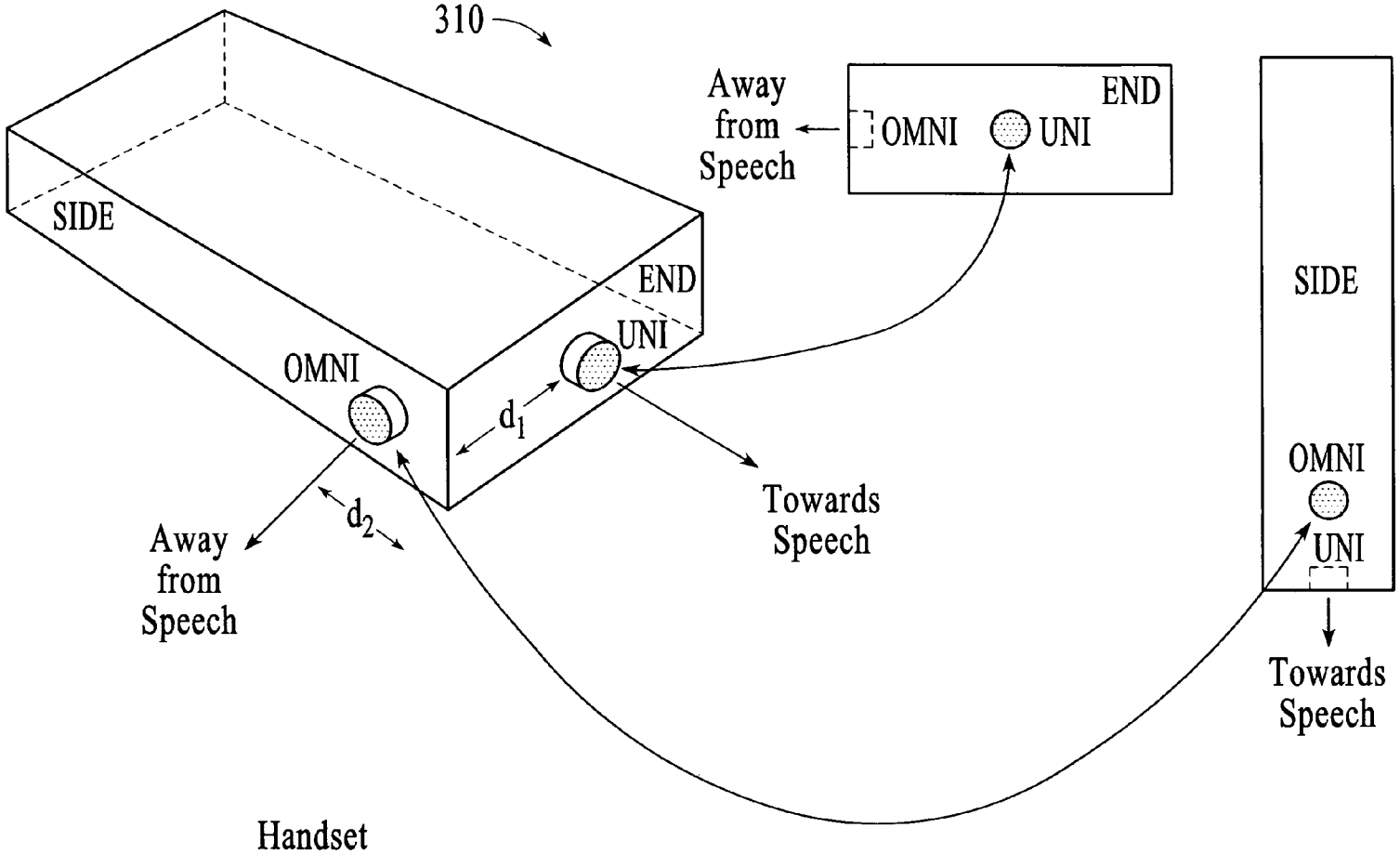
FIG. 3B shows a microphone configuration in a handset using a unidirectional speech microphone and an omnidirectional noise microphone, under the embodiment of FIG. 3A.
Figure 3C:
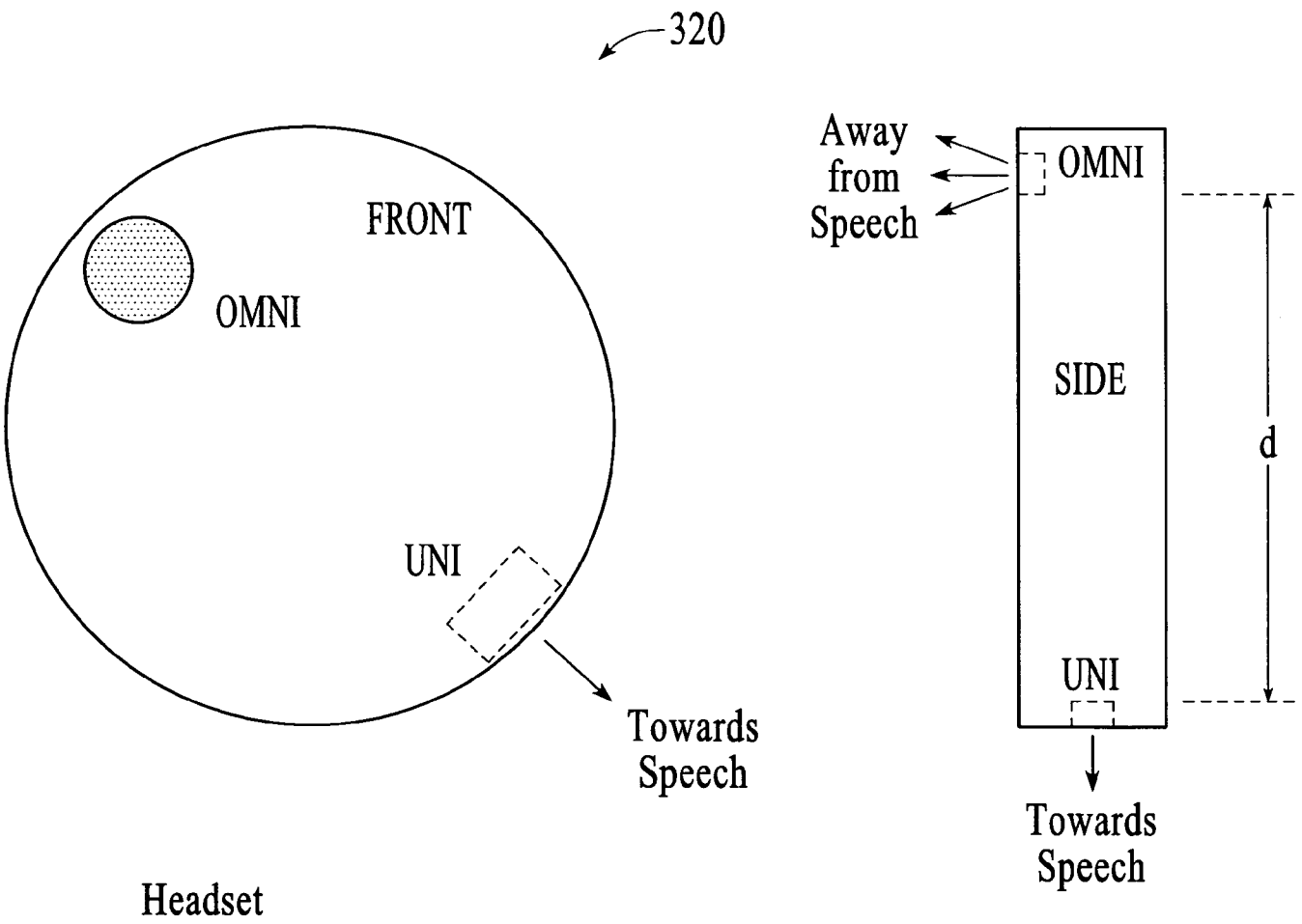
FIG. 3C shows a microphone configuration in a headset using a unidirectional speech microphone and an omnidirectional noise microphone, under the embodiment of FIG. 3A.

With reference to FIG. 1, in this configuration the UNI microphone is used as the speech microphone 103 and an OMNI is used as the noise microphone 104. They are normally used within a few centimeters of each other, but can be located 15 or more centimeters apart and still function adequately. FIG. 3A shows a general configuration 300 using a unidirectional speech microphone and an omnidirectional noise microphone, under an embodiment. The relative angle $f$ between a vector normal to the face of the microphones (a vector normal to UNI microphone is line labeled "TOWARDS SPEECH", and a vector normal to OMNI microphone is line labeled "AWAY FROM SPEECH") is approximately in the range of 60 to 135 degrees. The distances $d_1$ and $d_2$ are each approximately in the range of zero (0) to 15 centimeters. FIG. 3B shows a general configuration 310 in a handset using a unidirectional speech microphone and an omnidirectional noise microphone, under the embodiment of FIG. 3A. FIG. 3C shows a general configuration 320 in a headset using a unidirectional speech microphone and an omnidirectional noise microphone, under the embodiment of FIG. 3A.

The general configurations 310 and 320 show how the microphones can be oriented in a general fashion as well as a possible implementation of this setup for a handset and a headset, respectively. The UNI microphone, as the speech microphone, points toward the user's mouth. The OMNI has no specific orientation, but its location in this embodiment physically shields it from speech signals as much as possible. This setup works well for the Pathfinder system since the speech microphone contains mostly speech and the noise microphone mainly noise. Thus, the speech microphone has a high signal-to-noise ratio (SNR) and the noise microphone has a lower SNR. This enables the Pathfinder algorithm to be effective.

OMNI Microphone as Speech Microphone

In this embodiment, and referring to FIG. 1, the OMNI microphone is the speech microphone 103 and a UNI microphone is positioned as the noise microphone 104. The reason for this is to keep the amount of speech in the noise microphone small so that the Pathfinder algorithm can be simplified and de-signaling (the undesired removal of speech) can be kept to a minimum. This configuration has the most promise for simple add-ons to existing handsets, which already use an OMNI microphone to capture speech. Again, the two microphones can be located quite close together (within a few centimeters) or 15 centimeters or more away. The best performance is seen when the two microphones are quite close (less than approximately 5 cm), and the UNI is far enough away from the user's mouth (approximately in the range of 10 to 15 centimeters depending on the microphone) so that the UNI directionality functions effectively.

In this configuration where the speech microphone is an OMNI, the UNI is oriented in such a way as to keep the amount of speech in the UNI microphone small compared to the amount of speech in the OMNI. This means that the UNI will be oriented away from the speaker's mouth, and the amount it is oriented away from the speaker is denoted by $f$, which can vary between 0 and 180 degrees, where $f$ describes the angle between the direction of one microphone and the direction of another microphone in any plane.

Figure 4A:
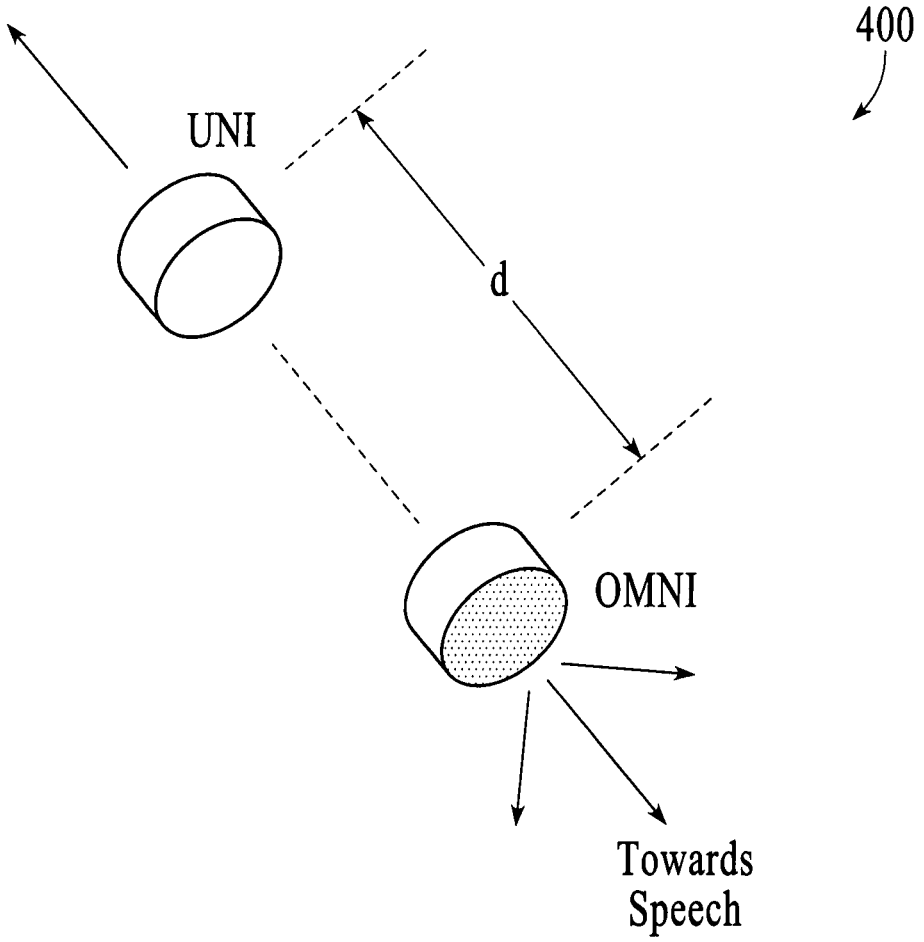
FIG. 4A shows a microphone configuration using an omnidirectional speech microphone and a unidirectional noise microphone, under an embodiment.
Figure 4B:
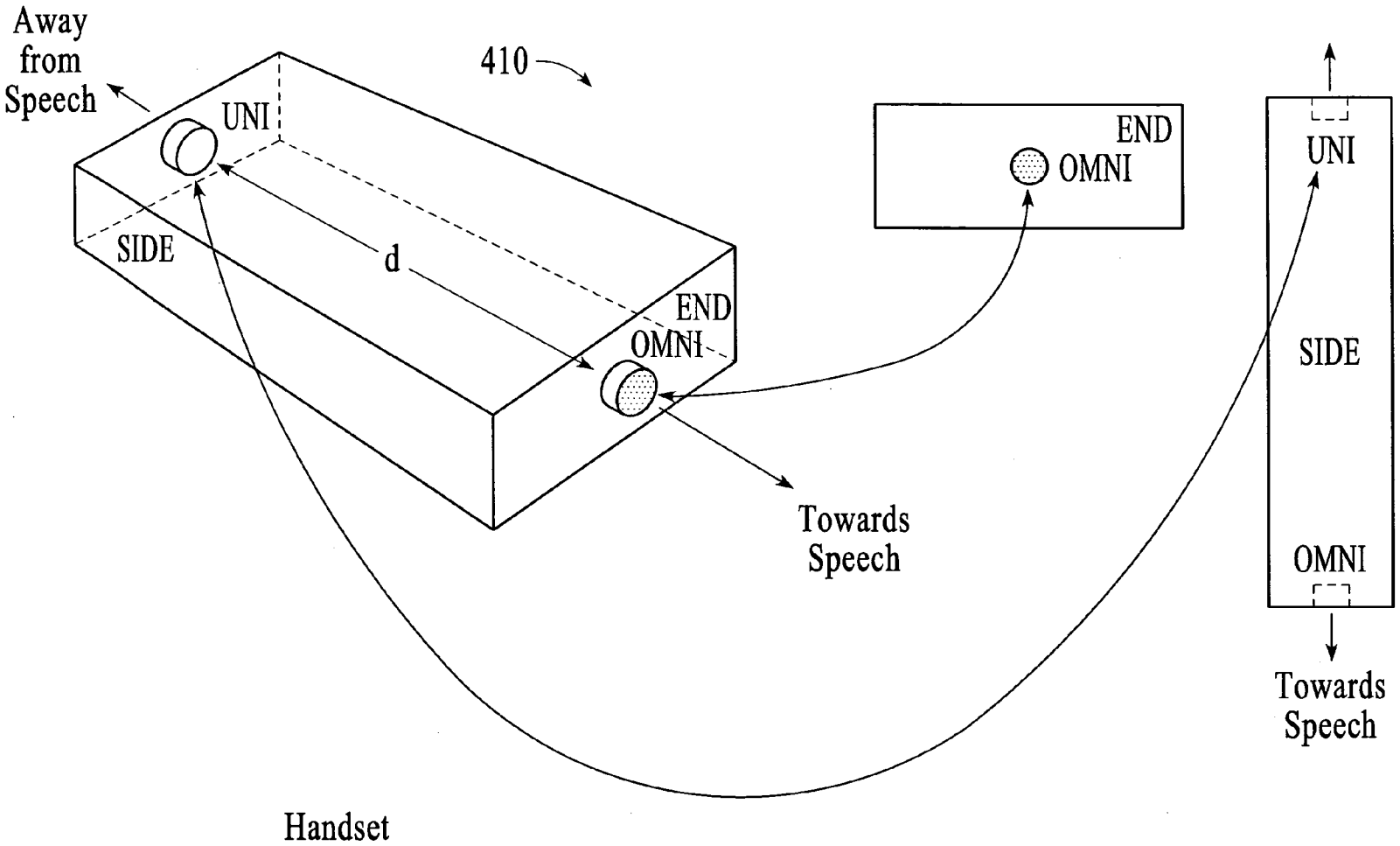
FIG. 4B shows a microphone configuration in a handset using an omnidirectional speech microphone and a unidirectional noise microphone, under the embodiment of FIG. 4A.
Figure 4C:
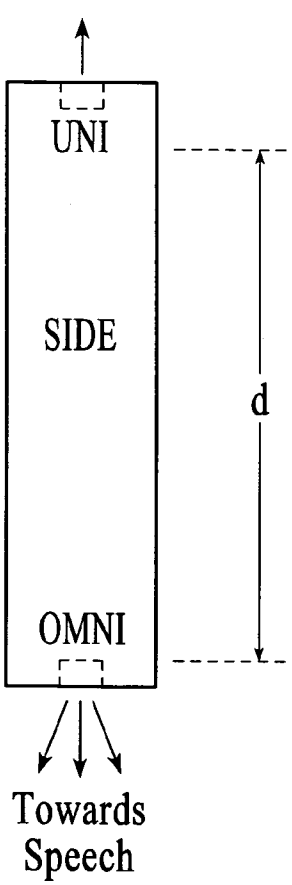
FIG. 4C shows a microphone configuration in a headset using an omnidirectional speech microphone and a unidirectional noise microphone, under the embodiment of FIG. 4A.
Figure 4C:
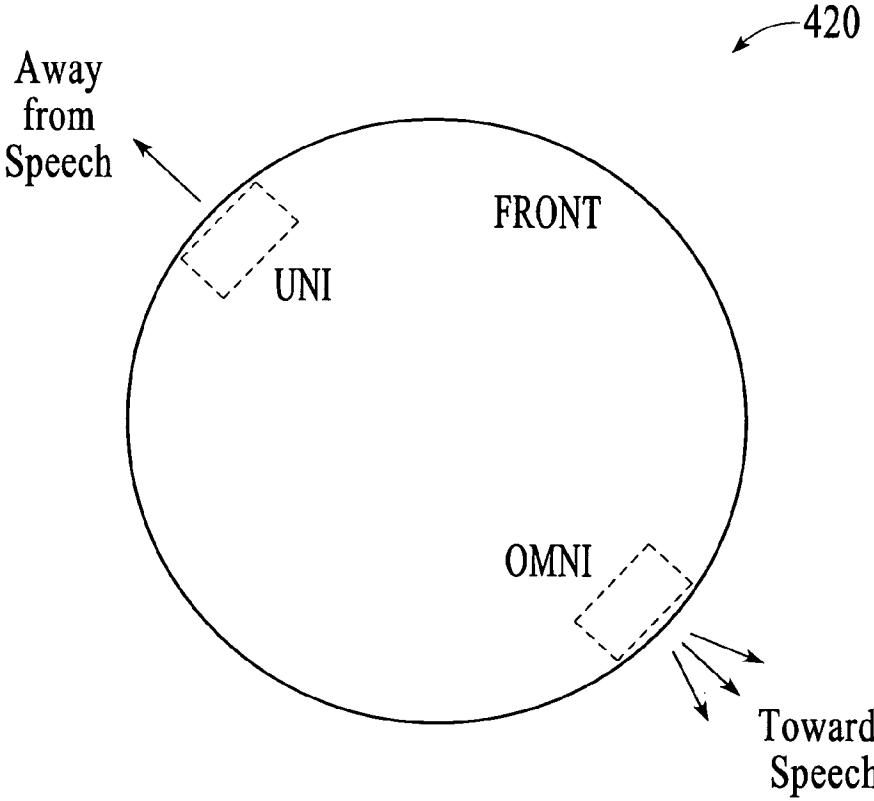

FIG. 4A shows a configuration 400 using an omnidirectional speech microphone and a unidirectional noise microphone, under an embodiment. The relative angle $f$ between vectors normal to the faces of the microphones is approximately 180 degrees. The distance d is approximately in the range of zero (0) to 15 centimeters. FIG. 4B shows a general configuration 410 in a handset using an omnidirectional speech microphone and a unidirectional noise microphone, under the embodiment of FIG. 4A. FIG. 4C shows a general configuration 420 in a headset using an omnidirectional speech microphone and a unidirectional noise microphone, under the embodiment of FIG. 4A.

Figure 5A:
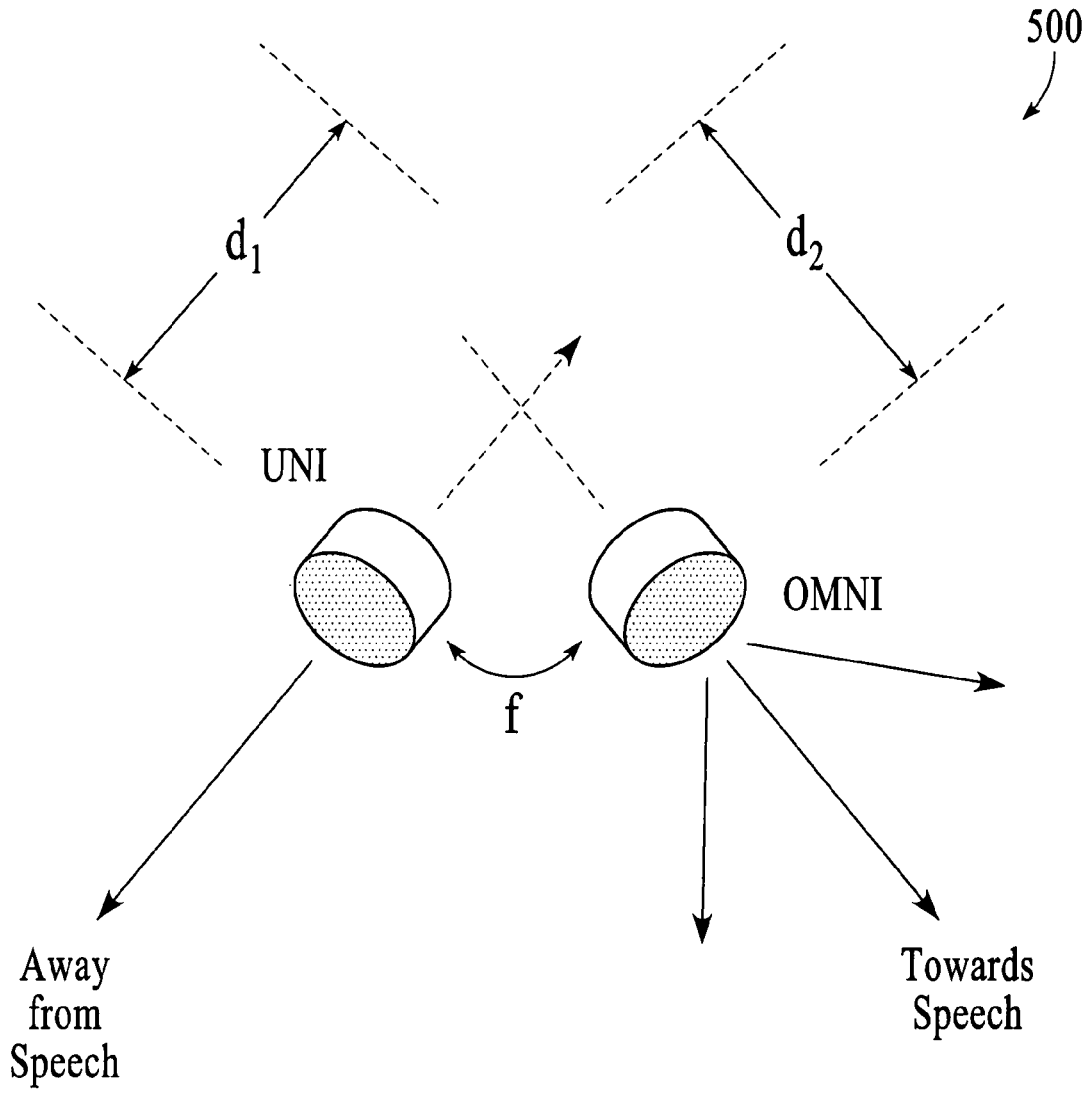
FIG. 5A shows a microphone configuration using an omnidirectional speech microphone and a unidirectional noise microphone, under an alternative embodiment.
Figure 5B:
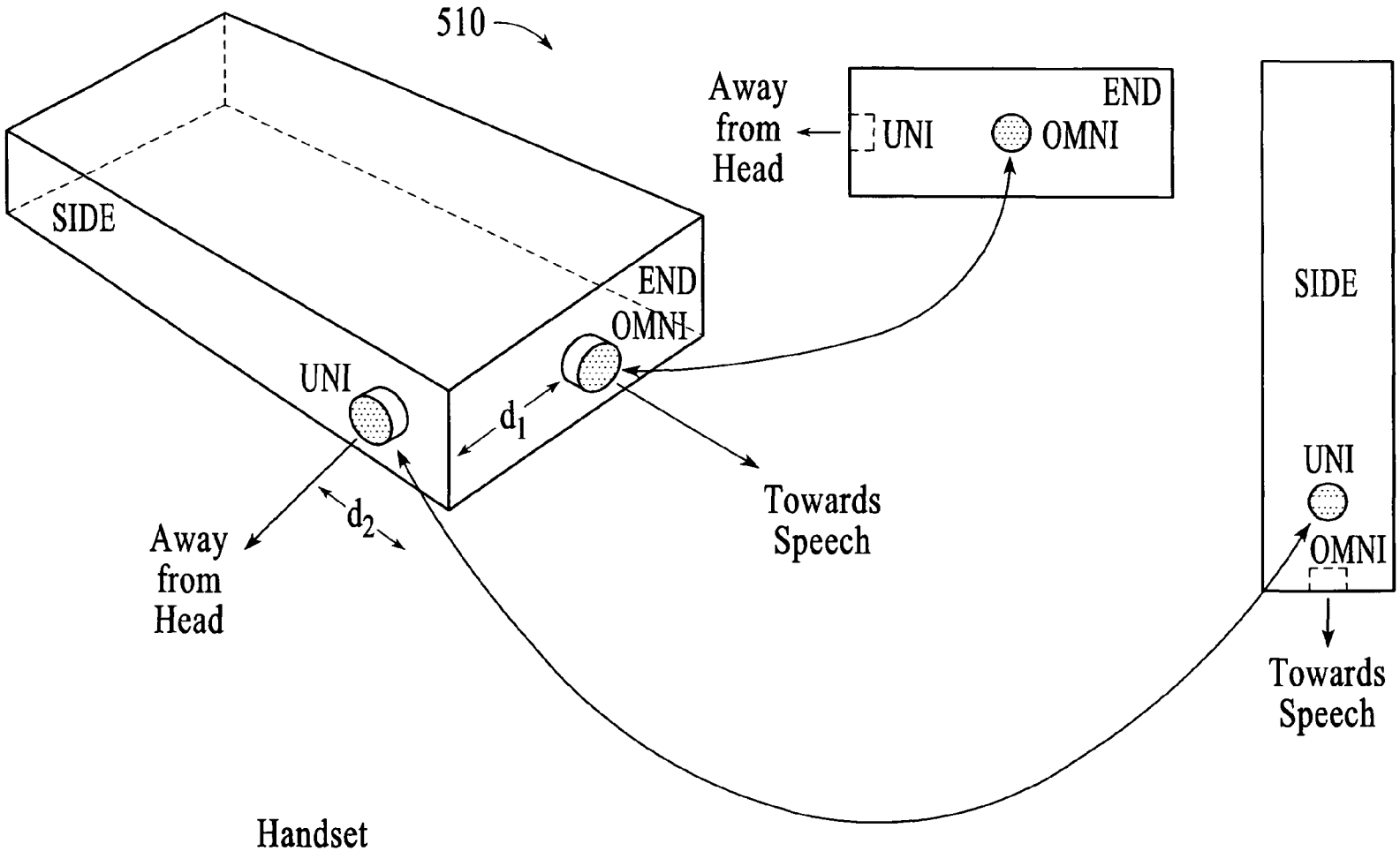
FIG. 5B shows a microphone configuration in a handset using an omnidirectional speech microphone and a unidirectional noise microphone, under the embodiment of FIG. 5A.
Figure 5C:
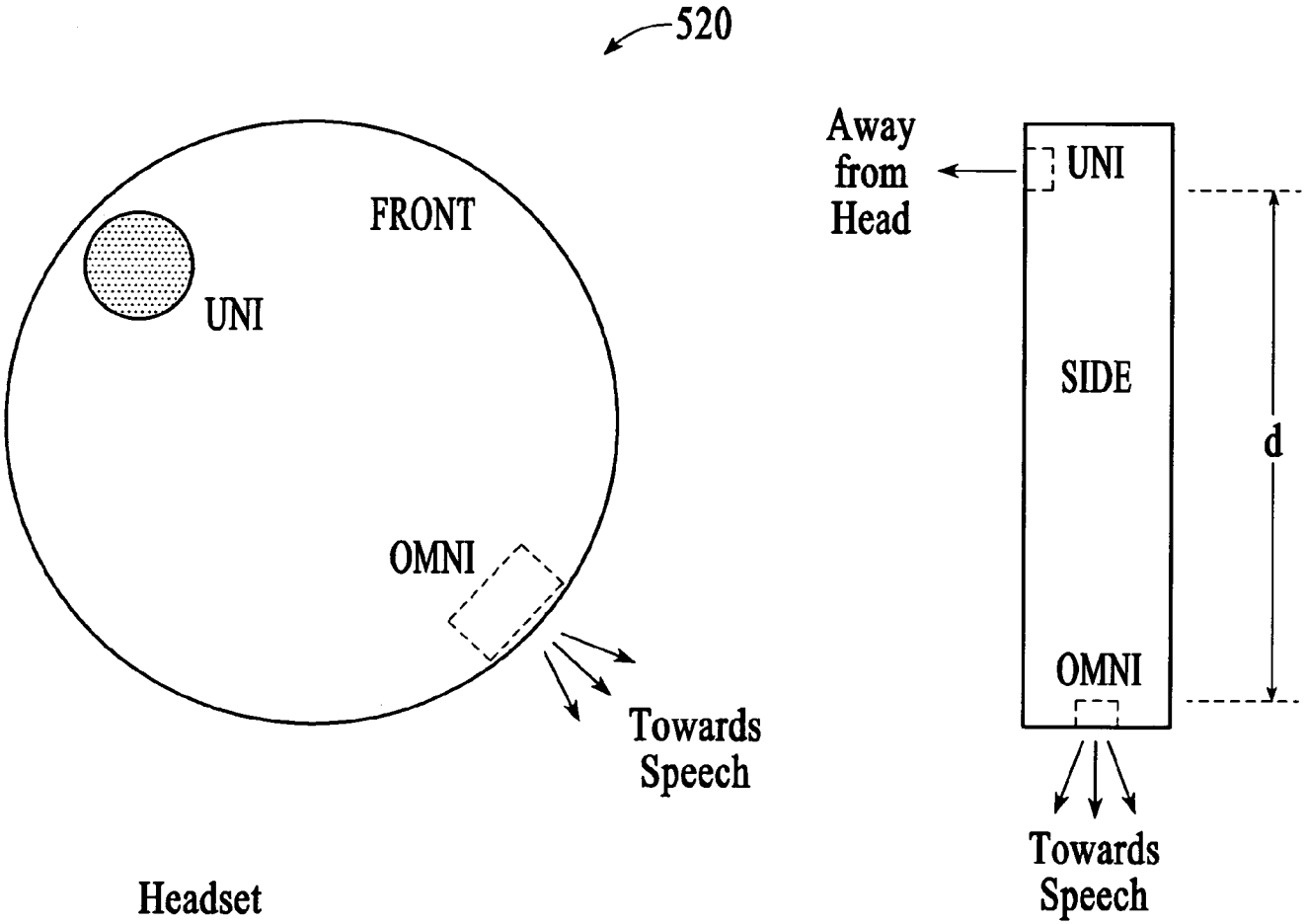
FIG. 5C shows a microphone configuration in a headset using an omnidirectional speech microphone and a unidirectional noise microphone, under the embodiment of FIG. 5A.

FIG. 5A shows a configuration 500 using an omnidirectional speech microphone and a unidirectional noise microphone, under an alternative embodiment. The relative angle $f$ between vectors normal to the faces of the microphones is approximately in a range between 60 and 135 degrees. The distances $d_1$ and $d_2$ are each approximately in the range of zero (0) to 15 centimeters. FIG. 5B shows a general configuration 510 in a handset using an omnidirectional speech microphone and a unidirectional noise microphone, under the embodiment of FIG. 5A. FIG. 5C shows a general configuration 520 in a headset using an omnidirectional speech microphone and a unidirectional noise microphone, under the embodiment of FIG. 5A.

The embodiments of FIGS. 4 and 5 are such that the SNR of MIC 1 is generally greater than the SNR of MIC 2. For large values of $f$ (around 180 degrees), the noise originating in front of the speaker may not be significantly captured, leading to slightly reduced denoising performance. In addition, if $f$ gets too small, a significant amount of speech can be captured by the noise microphone, increasing the denoised signal distortion and/or computational expense. Therefore it is recommended for maximum performance that the angle of orientation for the UNI microphone in this configuration to be approximately 60-135 degrees, as shown in FIG. 5. This allows the noise originating from the front of the user to be captured more easily, improving the denoising performance.

It also keeps the amount of speech signal captured by the noise microphone small so that the full capabilities of Pathfinder are not required. One skilled in the art will be able to quickly determine efficient angles for numerous other UNI/OMNI combinations through simple experimentation.

Microphone Arrays Including Two UNI Microphones

The microphone array of an embodiment includes two UNI microphones, where a first UNI microphone is the speech microphone and a second UNI microphone is the noise microphone. In the following description the maximum of the spatial response of the speech UNI is assumed oriented toward the user's mouth.

Noise UNI Microphone Oriented Away from Speaker

Similar to the configurations described above with reference to FIGS. 4A, 4B, and 4C and FIGS. 5A, 5B, and 5C, orienting the noise UNI away from the speaker can reduce the amount of speech captured by the noise microphone, allowing for the use of the simpler version of Pathfinder that only uses the calculation of $H_1(z)$ (as described below). Once again the angle of orientation with respect to the speaker's mouth can vary between approximately zero (0) and 180 degrees. At or near 180 degrees noise generated from in front of the user may not be captured well enough by the noise microphone to allow optimal suppression of the noise. Therefore if this configuration is used, it will work best if a cardioid is used as the speech microphone and a super-cardioid as the noise microphone. This will allow limited capture of noise to the front of the user, increasing the noise suppression. However, more speech may be captured as well and can result in de-signaling unless the full capabilities of Pathfinder are used in the signal processing. A compromise is sought between noise suppression, de-signaling, and computational complexity with this configuration.

Figure 6A:
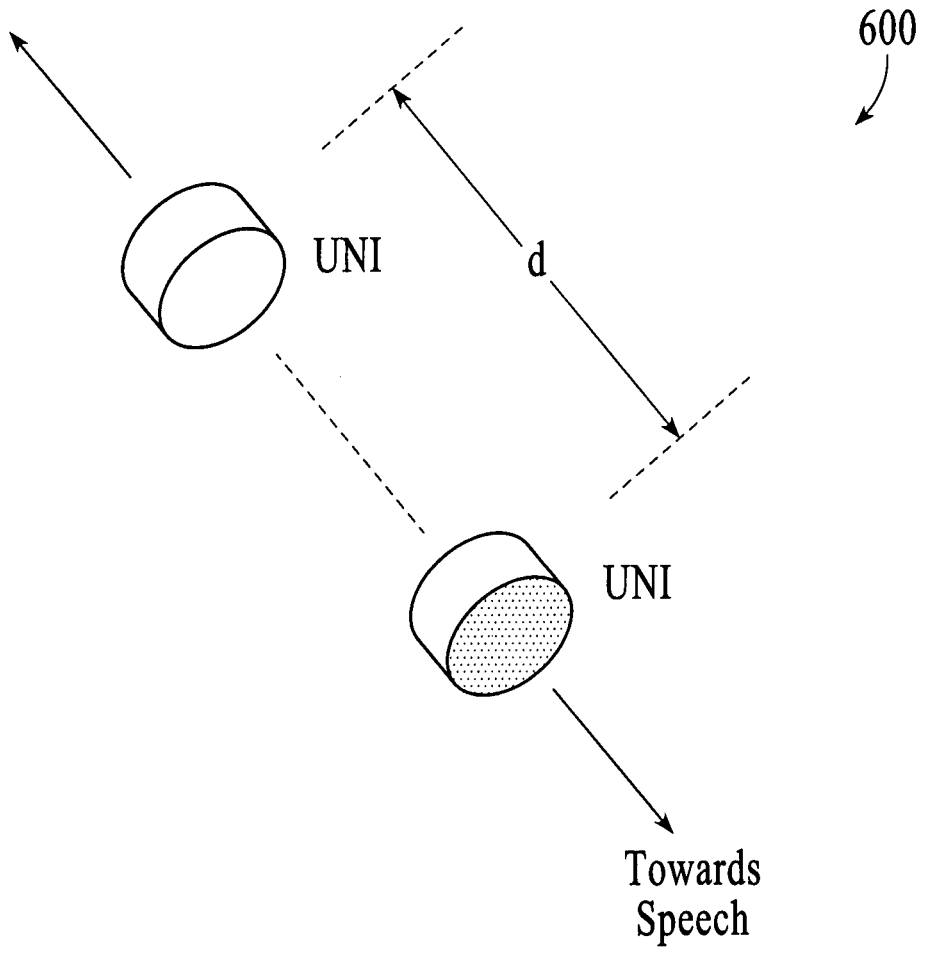
FIG. 6A shows a microphone configuration using a unidirectional speech microphone and a unidirectional noise microphone, under an embodiment.
Figure 6B:
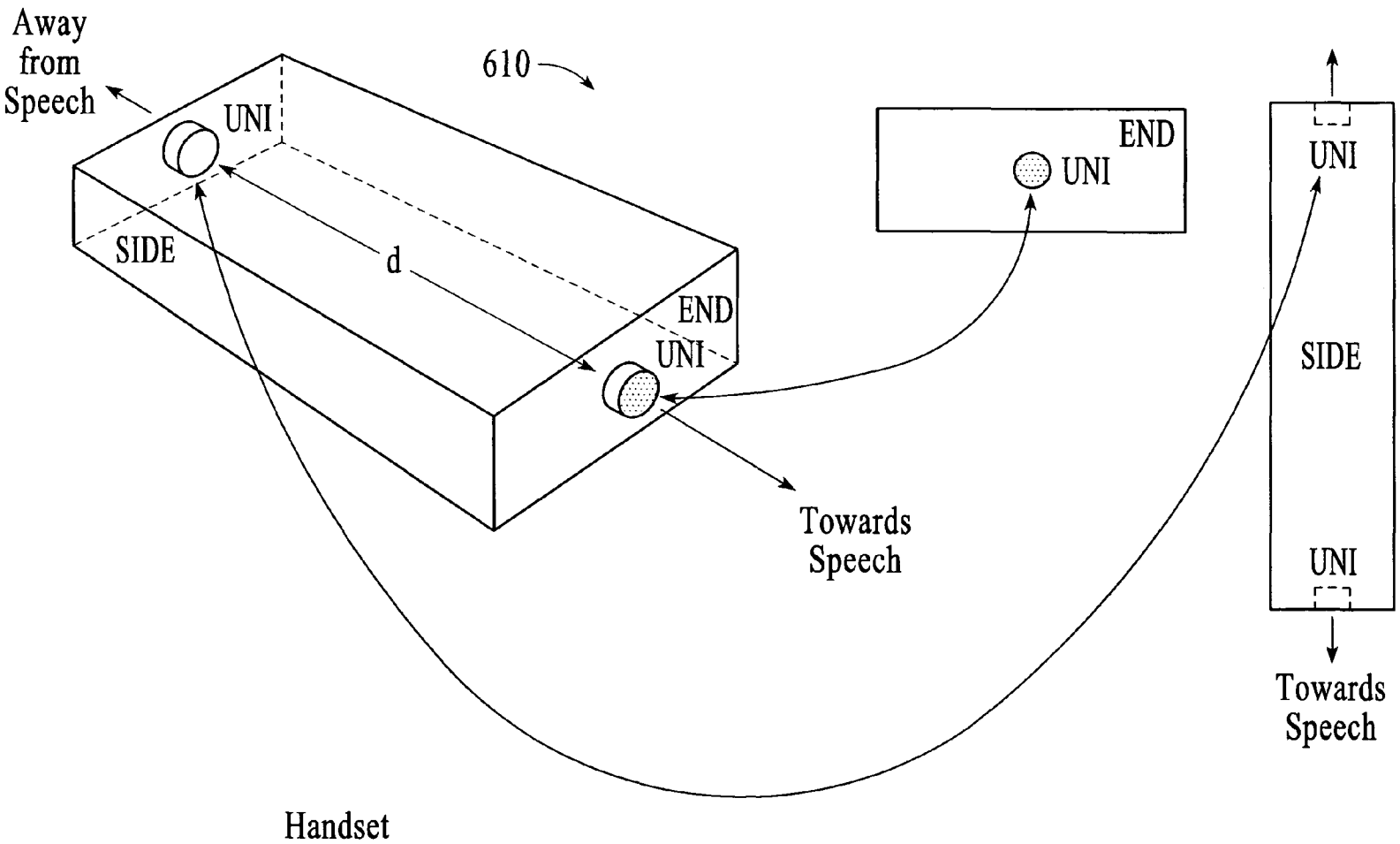
FIG. 6B shows a microphone configuration in a handset using a unidirectional speech microphone and a unidirectional noise microphone, under the embodiment of FIG. 6A.
Figure 6C:
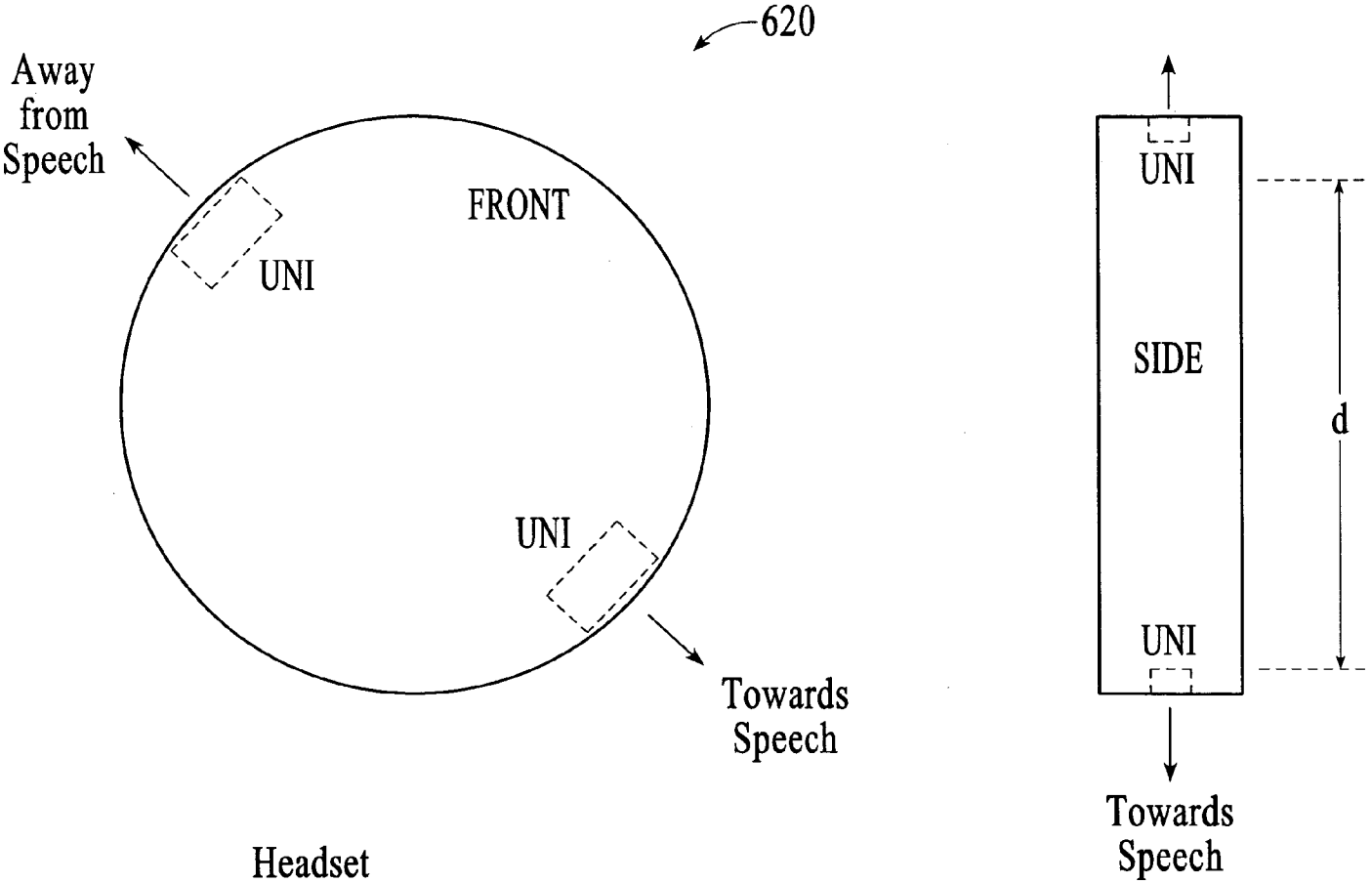
FIG. 6C shows a microphone configuration in a headset using a unidirectional speech microphone and a unidirectional noise microphone, under the embodiment of FIG. 6A.

FIG. 6A shows a configuration 600 using a unidirectional speech microphone and a unidirectional noise microphone, under an embodiment. The relative angle $f$ between vectors normal to the faces of the microphones is approximately 180 degrees. The distance d is approximately in the range of zero (0) to 15 centimeters. FIG. 6B shows a general configuration 610 in a handset using a unidirectional speech microphone and a unidirectional noise microphone, under the embodiment of FIG. 6A. FIG. 6C shows a general configuration 620 in a headset using a unidirectional speech microphone and a unidirectional noise microphone, under the embodiment of FIG. 6A.

Figure 7A:
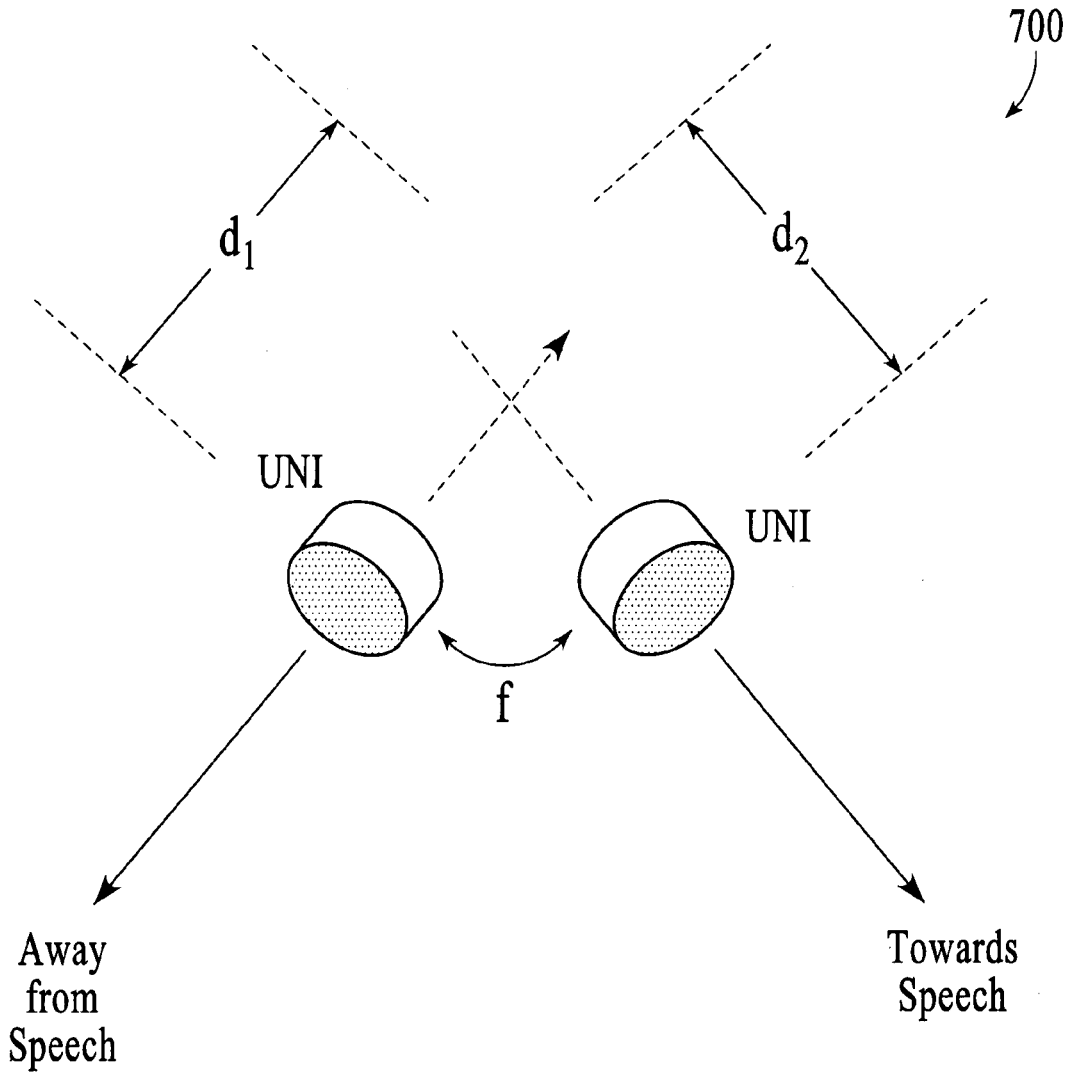
FIG. 7A shows a microphone configuration using a unidirectional speech microphone and a unidirectional noise microphone, under an alternative embodiment.
Figure 7B:
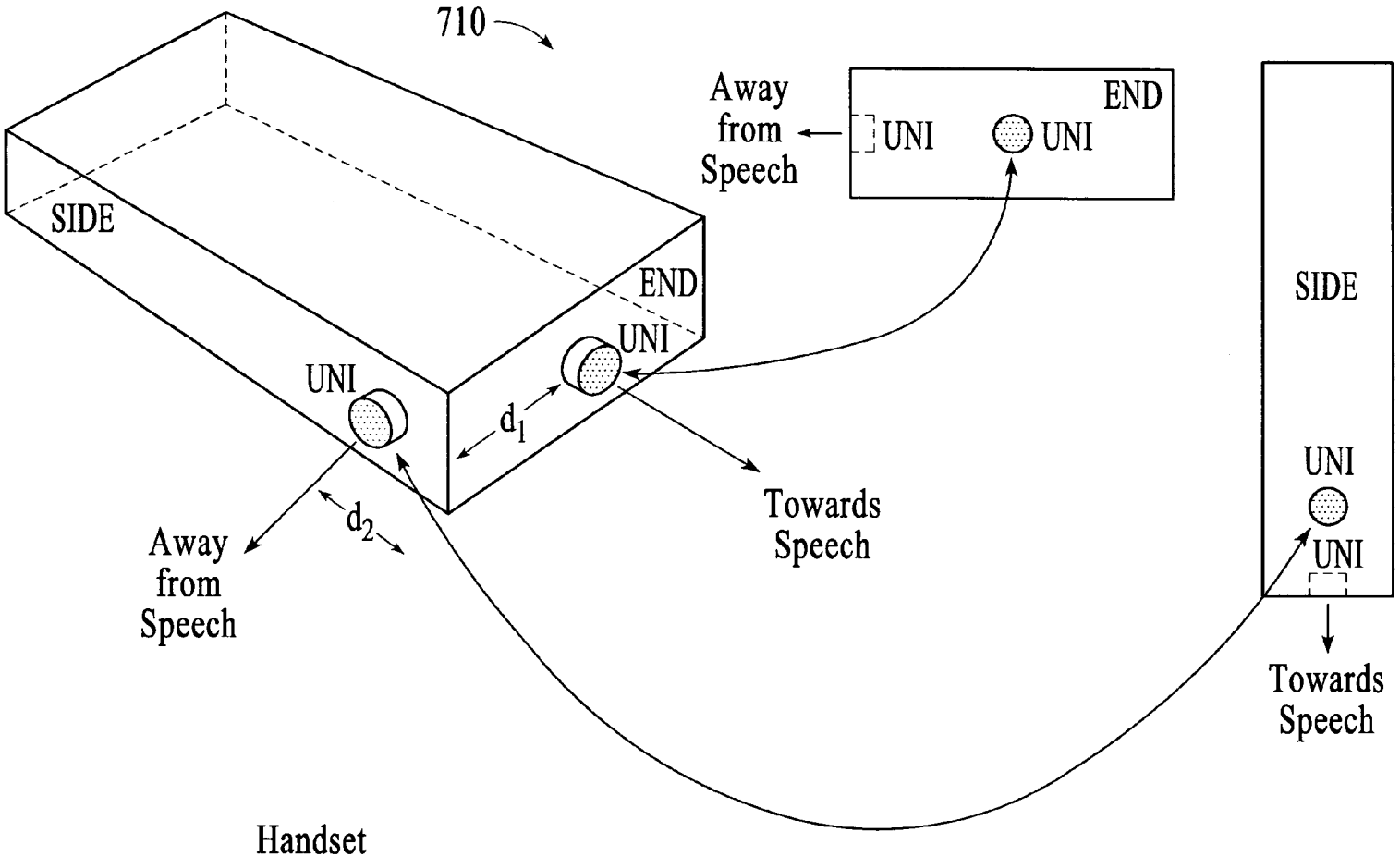
FIG. 7B shows a microphone configuration in a handset using a unidirectional speech microphone and a unidirectional noise microphone, under the embodiment of FIG. 7A.
Figure 7C:
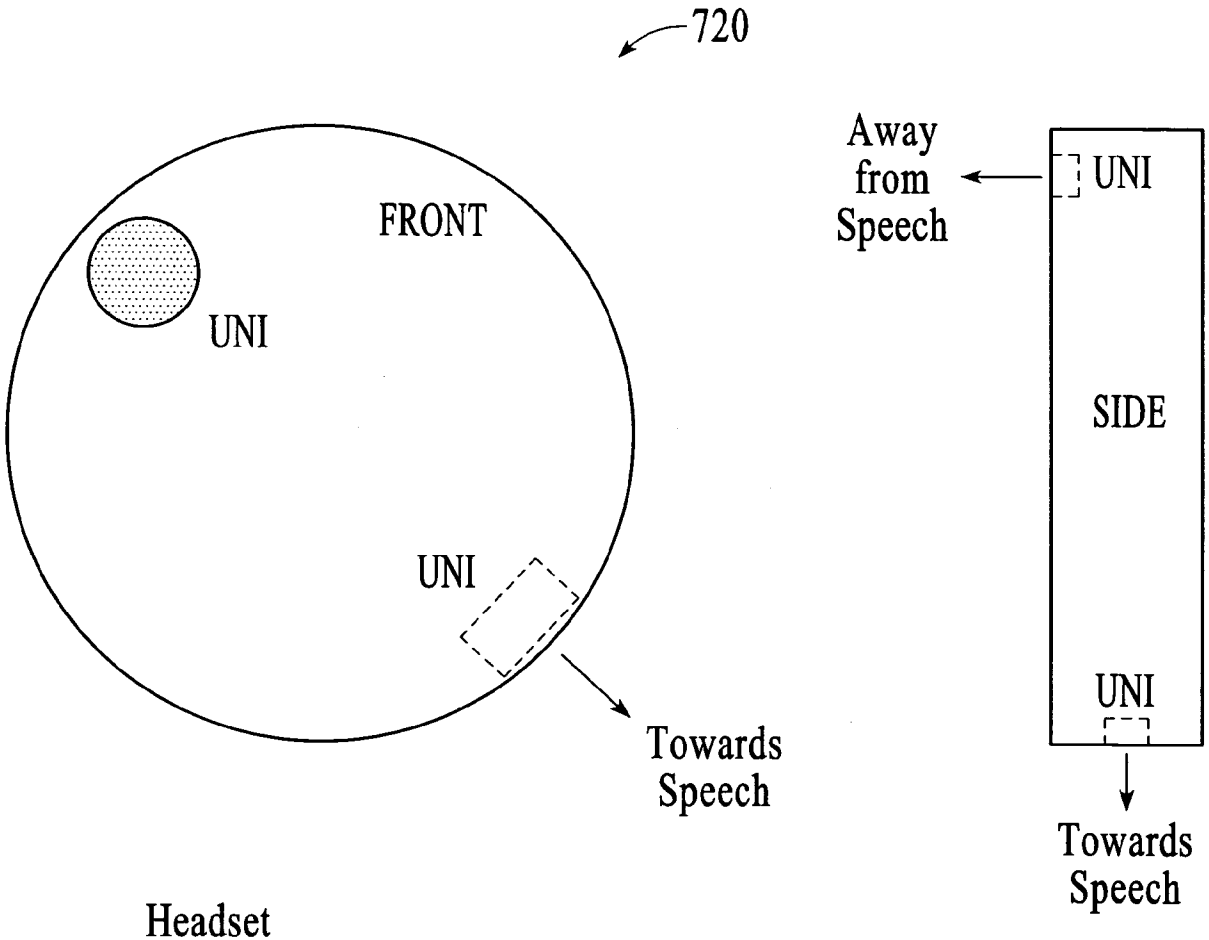
FIG. 7C shows a microphone configuration in a headset using a unidirectional speech microphone and a unidirectional noise microphone, under the embodiment of FIG. 7A.

FIG. 7A shows a configuration 700 using a unidirectional speech microphone and a unidirectional noise microphone, under an alternative embodiment. The relative angle $f$ between vectors normal to the faces of the microphones is approximately in a range between 60 and 135 degrees. The distances $d_1$ and $d_2$ are each approximately in the range of zero (0) to 15 centimeters. FIG. 7B shows a general configuration 710 in a handset using a unidirectional speech microphone and a unidirectional noise microphone, under the embodiment of FIG. 7A. FIG. 7C shows a general configuration 720 in a headset using a unidirectional speech microphone and a unidirectional noise microphone, under the embodiment of FIG. 7A. One skilled in the art will be able to determine efficient angles for the various UNI/UNI combinations using the descriptions herein.

UNI/UNI Microphone Array

Figure 8A:
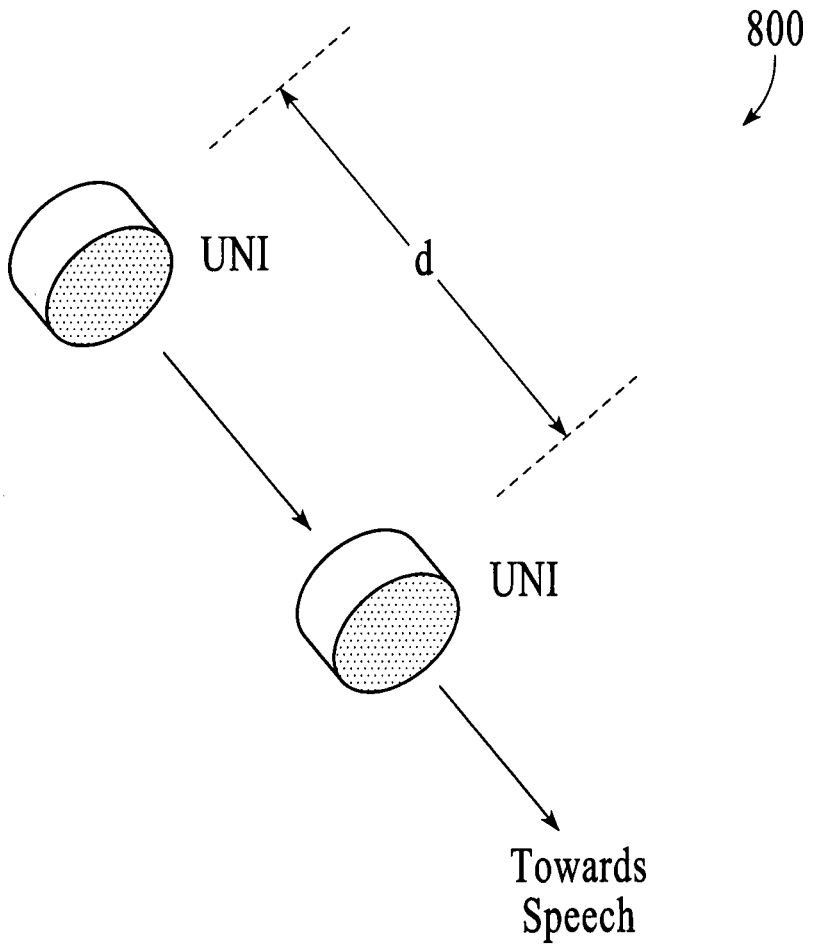
FIG. 8A shows a microphone configuration using a unidirectional speech microphone and a unidirectional noise microphone, under an embodiment.

FIG. 8A shows a configuration 800 using a unidirectional speech microphone and a unidirectional noise microphone, under an embodiment. The relative angle $f$ between vectors normal to the faces of the microphones is approximately 180 degrees. The microphones are placed on an axis 802 that contains the user's mouth at one end (towards speech) and the noise microphone 804 on the other. For optimal performance, the spacing d between the microphones should be multiples in space (d=1, 2, 3 . . . ) of a sample in time, but are not so limited. The two UNI microphones are not required to be on exactly the same axis with the speaker's mouth, and they may be offset up to 30 degrees or more without significantly affecting the denoising. However the best performance is observed when they are approximately directly in line with each other and the speaker's mouth. Other orientations can be used to those skilled in the art, but for best performance the differential transfer function between the two should be relatively simple. The two UNI microphones of this array can also act as a simple array for use in calculating a VAD signal, as discussed in the Related Applications.

Figure 8B:
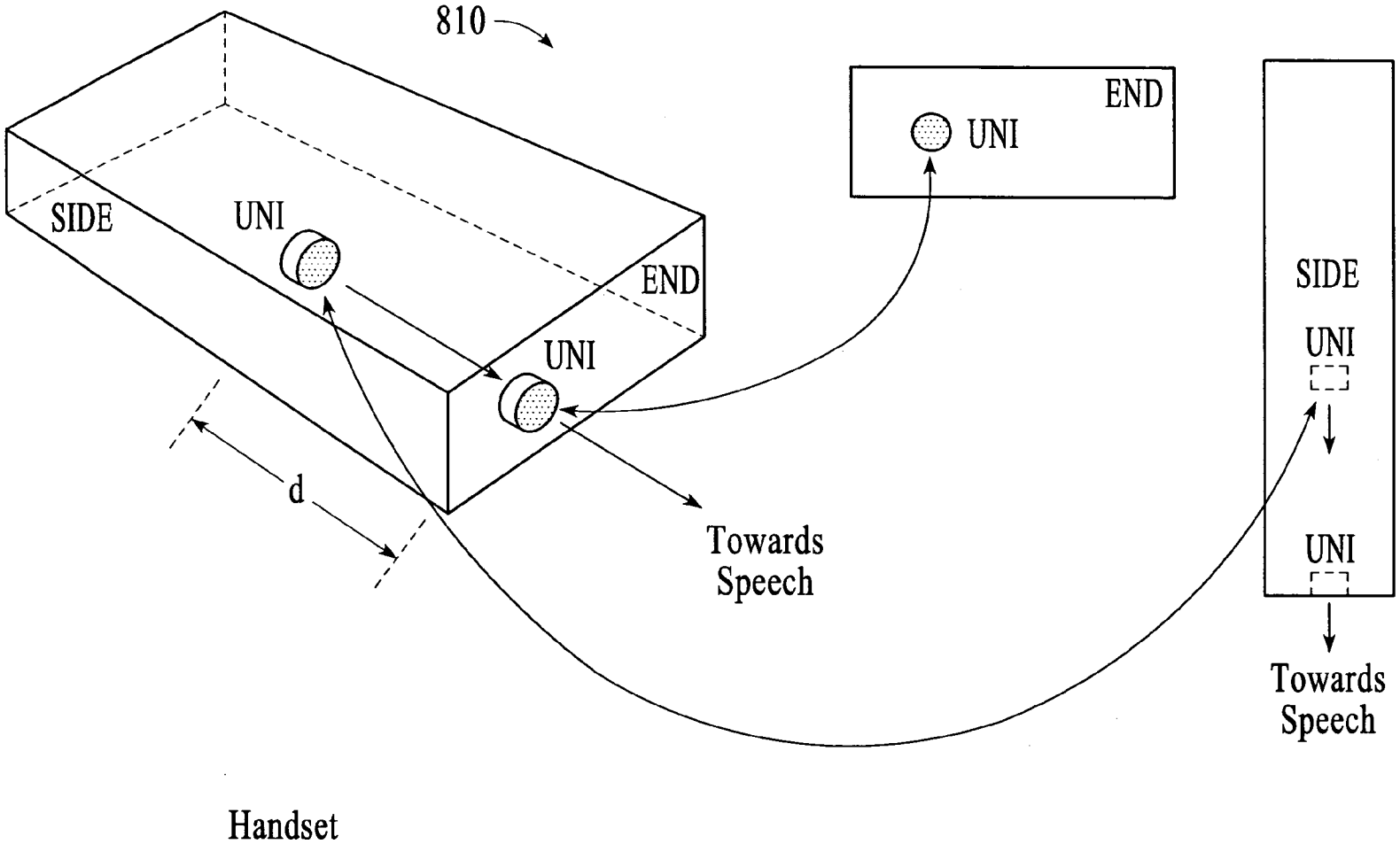
FIG. 8B shows a microphone configuration in a handset using a unidirectional speech microphone and a unidirectional noise microphone, under the embodiment of FIG. 8A.
Figure 8C:
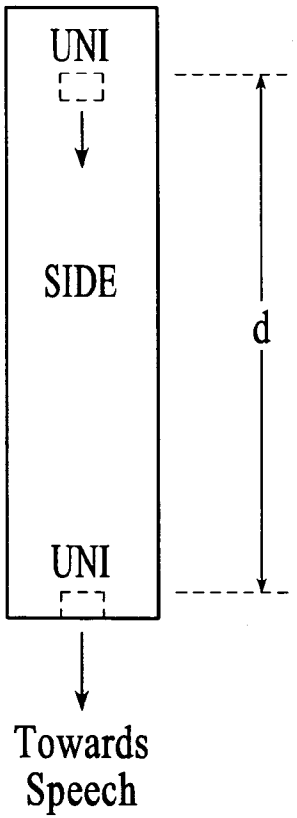
FIG. 8C shows a microphone configuration in a headset using a unidirectional speech microphone and a unidirectional noise microphone, under the embodiment of FIG. 8A.
Figure 8C:
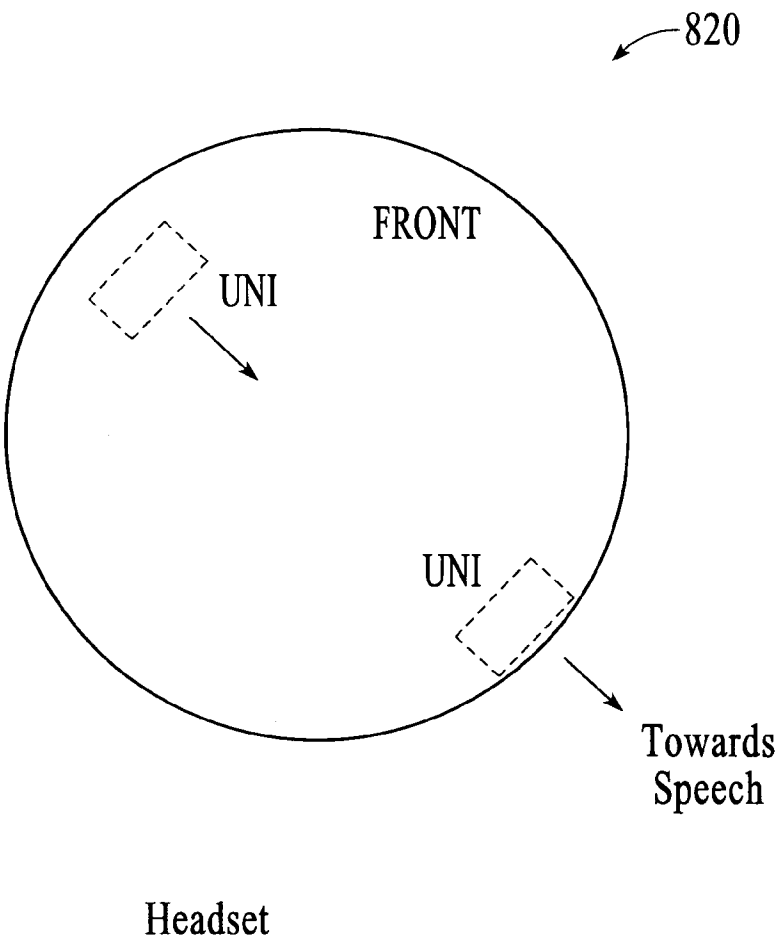

FIG. 8B shows a general configuration 810 in a handset using a unidirectional speech microphone and a unidirectional noise microphone, under the embodiment of FIG. 8A. FIG. 8C shows a general configuration 820 in a headset using a unidirectional speech microphone and a unidirectional noise microphone, under the embodiment of FIG. 8A.

When using the UNI/UNI microphone array, the same type of UNI microphone (cardioid, supercardioid, etc.) should be used. If this is not the case, one microphone could detect signals that the other microphone does not detect, causing a reduction in noise suppression effectiveness. The two UNI microphones should be oriented in the same direction, toward the speaker. Obviously the noise microphone will pick up a lot of speech, so the full version of the Pathfinder system should be used to avoid de-signaling.

Placement of the two UNI microphones on the axis that includes the user's mouth at one end and the noise microphone on the other, and use of a microphone spacing d that is a multiple in space of a sample in time allows the differential transfer function between the two microphones to be simple and therefore allows the Pathfinder system to operate at peak efficiency. As an example, if the acoustic data is sampled at 8 kHz, the time between samples is a multiple of 1/8000 seconds, or 0.125 milliseconds. The speed of sound in air is pressure and temperature dependent, but at sea level and room temperature it is about 345 meters per second. Therefore in 0.125 milliseconds the sound will travel 345(0.000125)=4.3 centimeters and the microphones should be spaced about 4.3 centimeters apart, or 8.6 cm, or 12.9 cm, and so on.

For example, and with reference to FIG. 8, if for an 8 kHz sampled system the distance d is chosen to be 1 sample length, or about 4.3 centimeters, then for acoustic sources located in front of MIC 1 on the axis connecting MIC 1 and MIC 2, the differential transfer function $H_2(z)$ would be $$H_2(z) = \frac{M_2(z)}{M_1(z)} = Cz^{-1},$$

where $M_n(z)$ is the discrete digital output from microphone n, C is a constant depending on the distance from MIC 1 to the acoustic source and the response of the microphones, and $z^{-1}$ is a simple delay in the discrete digital domain. Essentially, for acoustic energy originating from the user's mouth, the information captured by MIC 2 is the same as that captured by MIC 1, only delayed by a single sample (due to the 4.3 cm separation) and with a different amplitude. This simple $H_2(z)$ could be hardcoded for this array configuration and used with Pathfinder to denoise noisy speech with minimal distortion.

Microphone Arrays Including Two OMNI Microphones

The microphone array of an embodiment includes two OMNI microphones, where a first OMNI microphone is the speech microphone and a second OMNI microphone is the noise microphone.

Figure 9A:
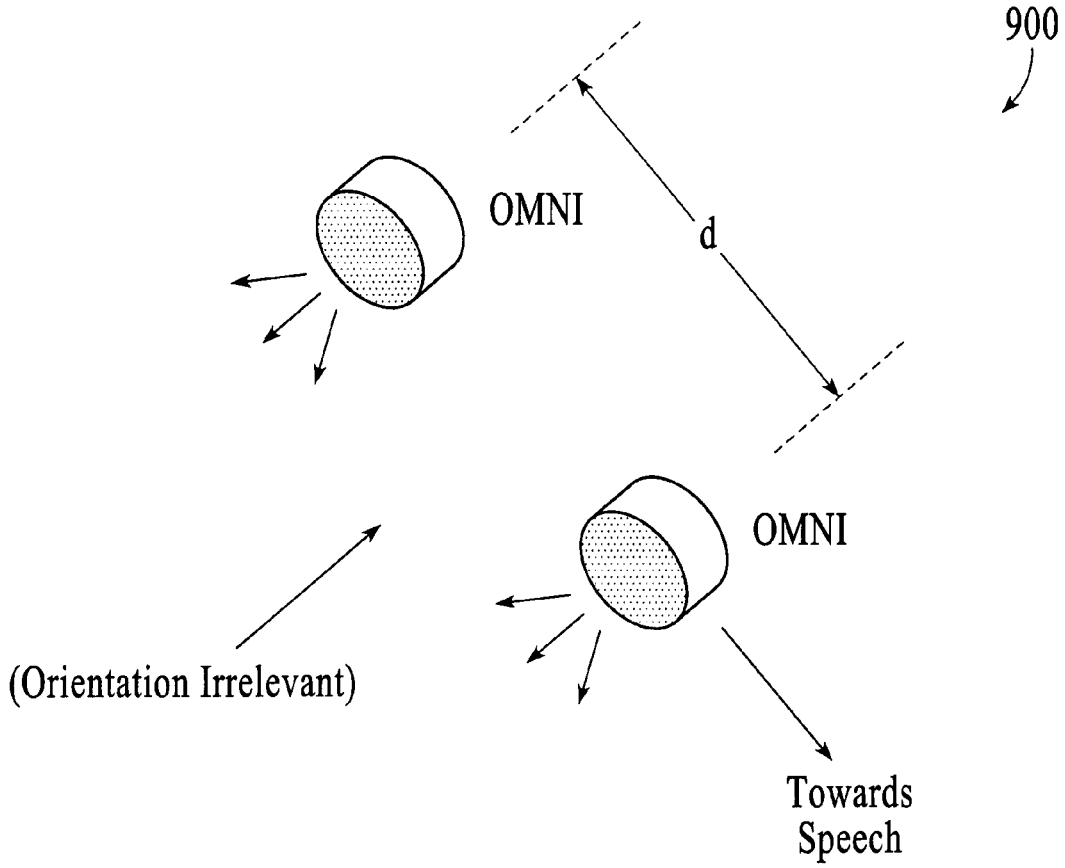
FIG. 9A shows a microphone configuration using an omnidirectional speech microphone and an omnidirectional noise microphone, under an embodiment.

FIG. 9A shows a configuration 900 using an omnidirectional speech microphone and an omnidirectional noise microphone, under an embodiment. The microphones are placed on an axis 902 that contains the user's mouth at one end (towards speech) and the noise microphone 904 on the other. For optimal performance, the spacing d between the microphones should be multiples in space (d=1, 2, 3 . . . ) of a sample in time, but are not so limited. The two OMNI microphones are not required to be on exactly the same axis with the speaker's mouth, and they may be offset up to 30 degrees or more without significantly affecting the denoising. However the best performance is observed when the microphones are approximately directly in line with each other and the speaker's mouth. Other orientations can be used to those skilled in the art, but for best performance the differential transfer function between the two should be relatively simple, as in the previous section described using two UNI microphones. The two OMNI microphones of this array can also act as a simple array for use in calculating a VAD signal, as discussed in the Related Applications.

Figure 9B:
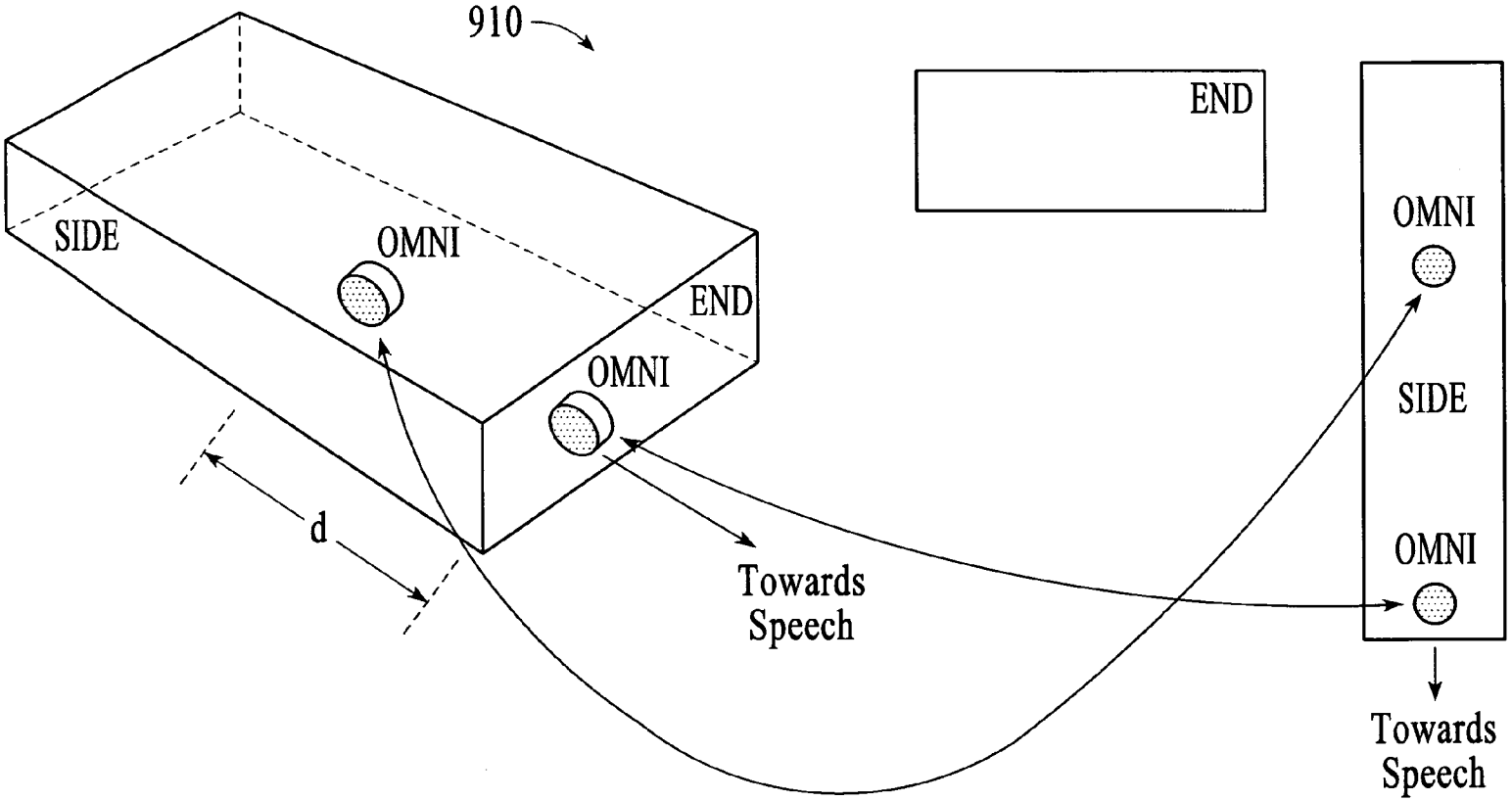
FIG. 9B shows a microphone configuration in a handset using an omnidirectional speech microphone and an omnidirectional noise microphone, under the embodiment of FIG. 9A.
Figure 9C:
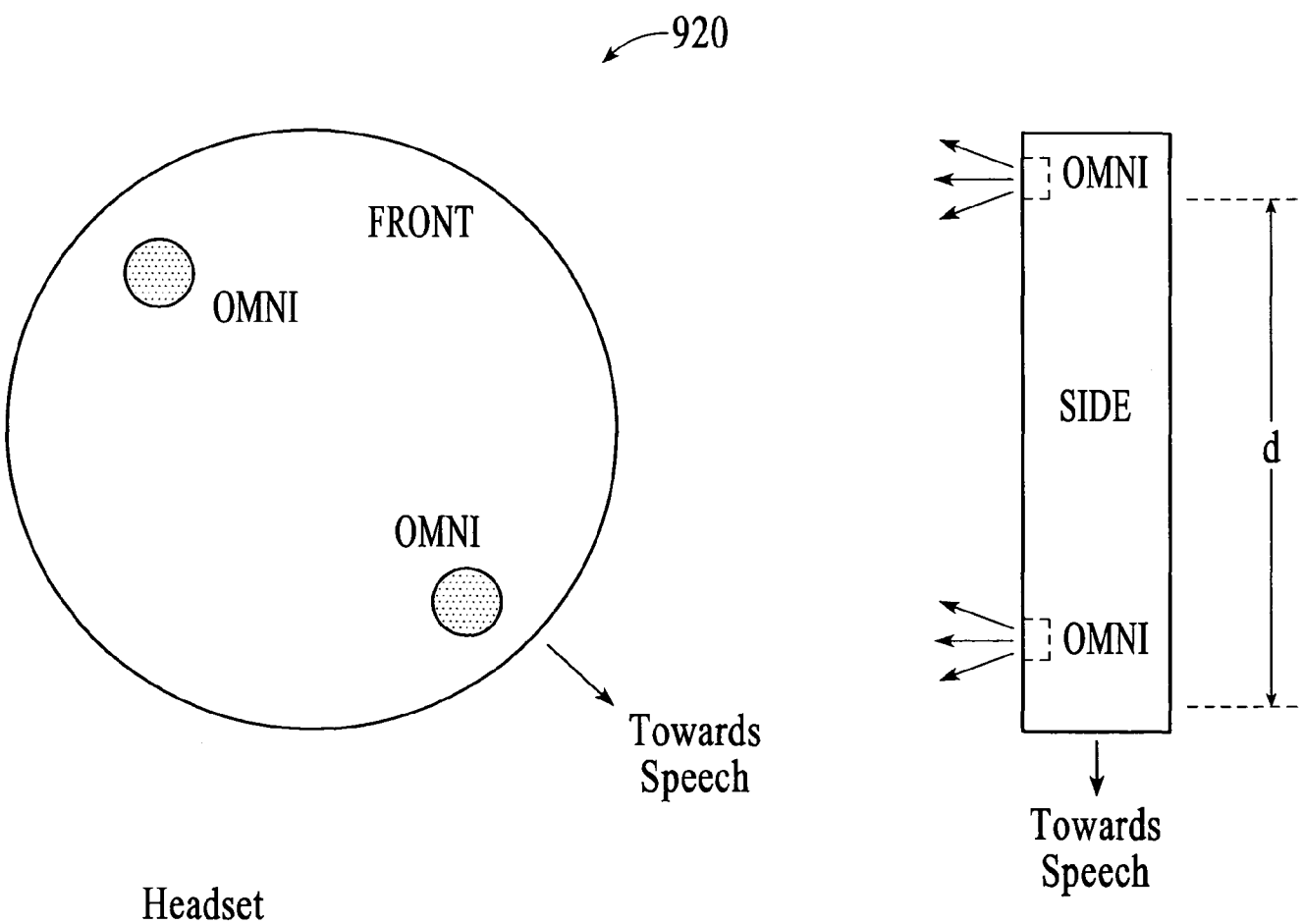
FIG. 9C shows a microphone configuration in a headset using an omnidirectional speech microphone and an omnidirectional noise microphone, under the embodiment of FIG. 9A.

FIG. 9B shows a general configuration 910 in a handset using an omnidirectional speech microphone and an omnidirectional noise microphone, under the embodiment of FIG. 9A. FIG. 9C shows a general configuration 920 in a headset using an omnidirectional speech microphone and an omnidirectional noise microphone, under the embodiment, of FIG. 9A.

As with the UNI/UNI microphone array described above, perfect alignment between the two OMNI microphones and the speaker's mouth is not strictly necessary, although that alignment offers the best performance. This configuration is a likely implementation for handsets, for both price reasons (OMNIs are less expensive than UNIs) and packaging reasons (it is simpler to properly vent OMNIs than UNIs).

Voice Activity Detection (VAD) Devices

Referring to FIG. 1A, a VAD device is a component of the noise suppression system of an embodiment. Following are a number of VAD devices for use in a noise suppression system and a description how each may be implemented for both a handset and a headset application. The VAD is a component of the Pathfinder denoising system, as described in U.S. patent application Ser. No. 10/383,162, entitled VOICE ACTIVITY DETECTION (VAD) DEVICES AND METHODS FOR USE WITH NOISE SUPPRESSION SYSTEMS, filed Mar. 5, 2003.

General Electromagnetic Sensor (GEMS) VAD

The GEMS is a radiofrequency (RF) interferometer that operates in the 1-5 GHz frequency range at very low power, and can be used to detect vibrations of very small amplitude. The GEMS is used to detect vibrations of the trachea, neck, cheek, and head associated with the production of speech. These vibrations occur due to the opening and closing of the vocal folds associated with speech production, and detecting them can lead to a very accurate noise-robust VAD, as described in the Related Applications.

Figure 10A:
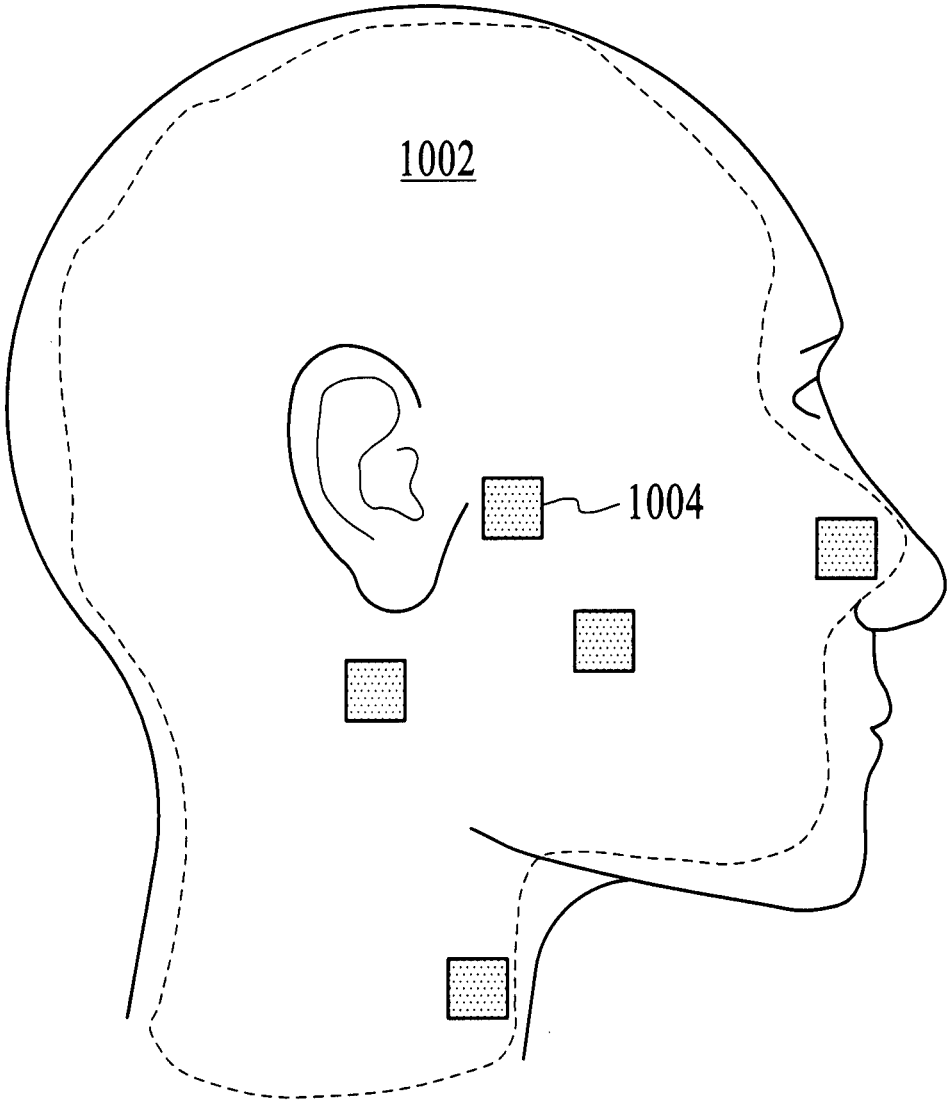
FIG. 10A shows an area of sensitivity on the human head appropriate for receiving a GEMS sensor, under an embodiment.

FIG. 10A shows an area of sensitivity 1002 on the human head appropriate for receiving a GEMS sensor, under an embodiment. The area of sensitivity 1002 further includes areas of optimal sensitivity 1004 near which a GEMS sensor can be placed to detect vibrational signals associated with voicing. The area of sensitivity 1002 along with the areas of optimal sensitivity 1004 is the same for both sides of the human head. Furthermore, the area of sensitivity 1002 includes areas on the neck and chest (not shown).

As the GEMS is an RF sensor, it uses an antenna. Very small (from approximately 4 mm by 7 mm to about 20 mm by 20 mm) micropatch antennae have been constructed and used that allow the GEMS to detect vibrations. These antennae are designed to be close to the skin for maximum efficiency. Other antennae may be used as well. The antennae may be mounted in the handset or earpiece in any manner, the only restriction being that sufficient energy to detect the vibration must reach the vibrating objects. In some cases this will require skin contact, in others skin contact may not be needed.

Figure 10B:
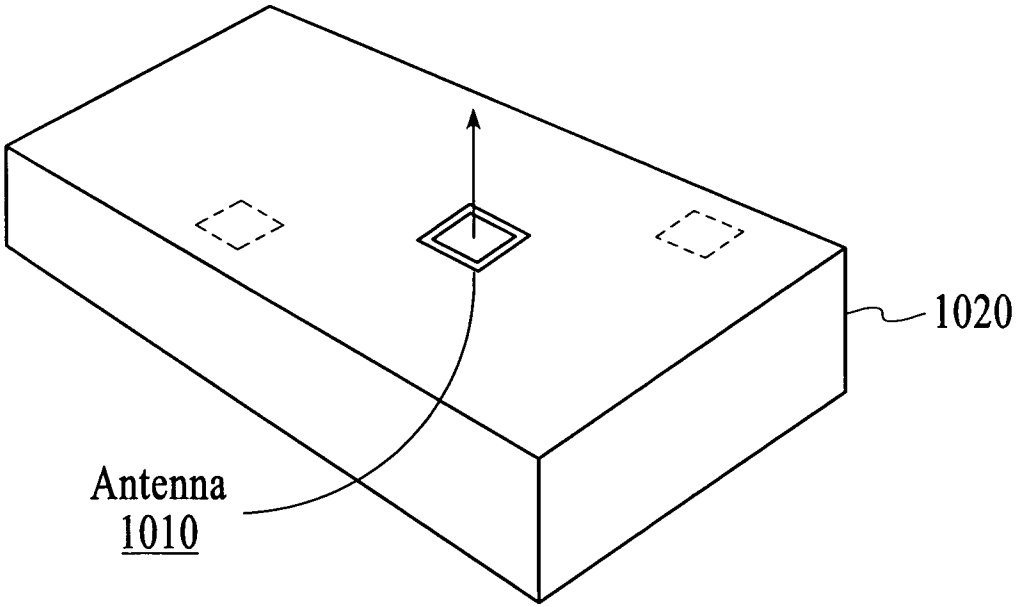
FIG. 10B shows GEMS antenna placement on a generic handset or headset device, under an embodiment.

FIG. 10B shows GEMS antenna placement 1010 on a generic handset or headset device 1020, under an embodiment. Generally, the GEMS antenna placement 1010 can be on any part of the device 1020 that corresponds to the area of sensitivity 1002 (FIG. 10A) on the human head when the device 1020 is in use.

Surface Skin Vibration-Based VAD

As described in the Related Applications, accelerometers and devices called Skin Surface Microphones (SSMs) can be used to detect the skin vibrations that occur due to the production of speech. However, these sensors can be polluted by exterior acoustic noise, and so care must be taken in their placement and use. Accelerometers are well known and understood, and the SSM is a device that can also be used to detect vibrations, although not with the same fidelity as the accelerometer. Fortunately, constructing a VAD does not require high fidelity reproduction of the underlying vibration, just the ability to determine if vibrations are taking place. For this the SSM is well suited.

The SSM is a conventional microphone modified to prevent airborne acoustic information from coupling with the microphone's detecting elements. A layer of silicone gel or other covering changes the impedance of the microphone and prevents airborne acoustic information from being detected to a significant degree. Thus this microphone is shielded from airborne acoustic energy but is able to detect acoustic waves traveling in media other than air as long as it maintains physical contact with the media.

During speech, when the accelerometer/SSM is placed on the cheek or neck, vibrations associated with speech production are easily detected. However, the airborne acoustic data is not significantly detected by the accelerometer/SSM. The tissue-borne acoustic signal, upon detection by the accelerometer/SSM, is used to generate a VAD signal used to process and denoise the signal of interest.

Skin Vibrations in the Ear

One placement that can be used to cut down on the amount of external noise detected by the accelerometer/SSM and assure a good fit is to place the accelerometer/SSM in the ear canal. This is already done in some commercial products, such as Temco's Voiceducer, where the vibrations are directly used as the input to a communication system. In the noise suppression systems described herein, however, the accelerometer signal is only used to calculate a VAD signal. Therefore the accelerometer/SSM in the ear can be less sensitive and require less bandwidth, and thus be less expensive.

Skin Vibrations Outside the Ear

Figure 11A:
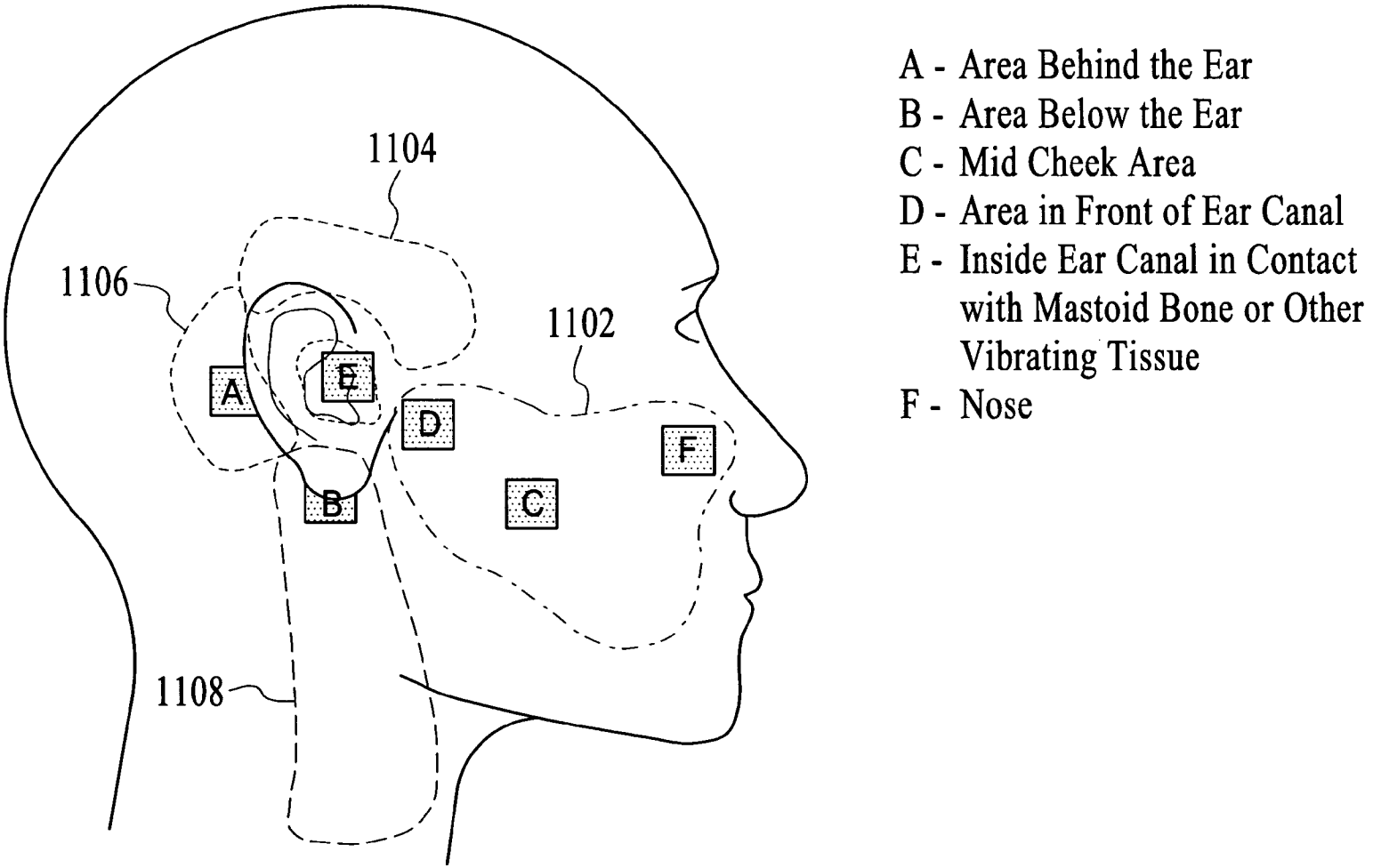
FIG. 11A shows areas of sensitivity on the human head appropriate for placement of an accelerometer/SSM, under an embodiment.

There are many locations outside the ear from which the accelerometer/SSM can detect skin vibrations associated with the production of speech. The accelerometer/SSM may be mounted in the handset or earpiece in any manner, the only restriction being that reliable skin contact is required to detect the skin-borne vibrations associated with the production of speech. FIG. 11A shows areas of sensitivity 1102, 1104, 1106, 1108 on the human head appropriate for placement of an accelerometer/SSM, under an embodiment. The areas of sensitivity include areas of the jaw 1102, areas on the head 1104, areas behind the ear 1106, and areas on the side and front of the neck 1108. Furthermore, the areas of sensitivity include areas on the neck and chest (not shown). The areas of sensitivity 1102-1108 are the same for both sides of the human head.

The areas of sensitivity 1102-1108 include areas of optimal sensitivity A-F where speech can be reliably detected by a SSM, under an embodiment. The areas of optimal sensitivity A-F include, but are not limited to, the area behind the ear A, the area below the ear B, the mid-cheek area C of the jaw, the area in front of the ear canal D, the area E inside the ear canal in contact with the mastoid bone or other vibrating tissue, and the nose F. Placement of an accelerometer/SSM in the proximity of any of these areas of sensitivity 1102-1108 will work with a headset, but a handset requires contact with the cheek, jaw, head, or neck. The above areas are only meant to guide, and there may be other areas not specified where useful vibrations can also be detected.

Figure 11B:
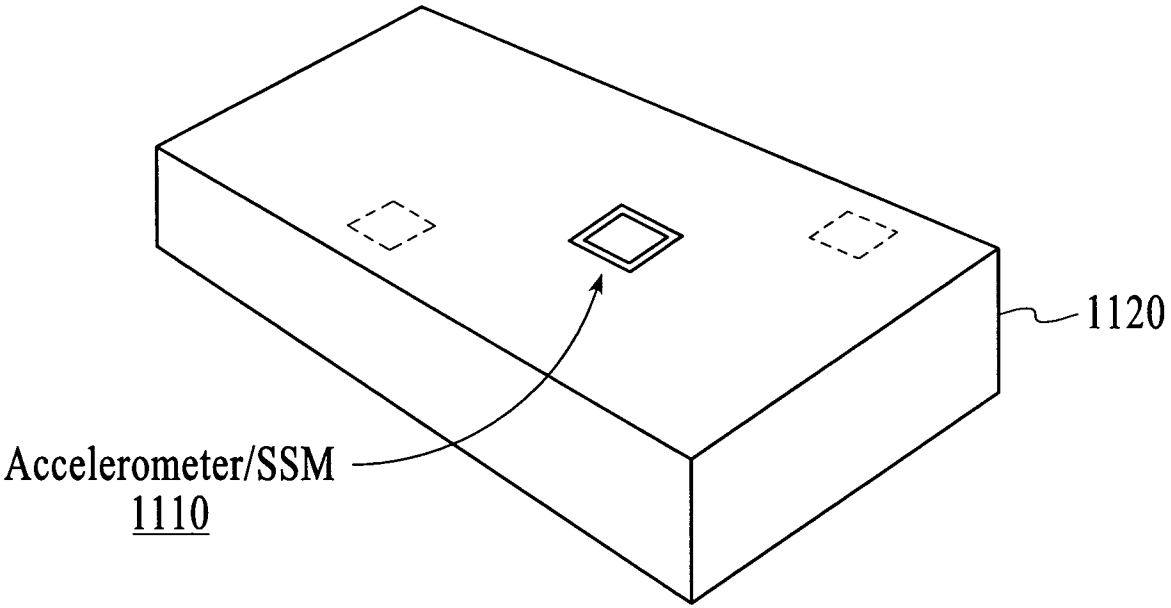
FIG. 11B shows accelerometer/SSM placement on a generic handset or headset device, under an embodiment.

FIG. 11B shows accelerometer/SSM placement 1110 on a generic handset or headset device 1120, under an embodiment. Generally, the accelerometer/SSM placement 1110 can be on any part of the device 1120 that corresponds to the areas of sensitivity 1102-1108 (FIG. 11A) on the human head when the device 1120 is in use.

Two-Microphone Acoustic VAD

These VADs, which include array VAD, Pathfinder VAD, and stereo VAD, operate with two microphones and without any external hardware. Each of the array VAD, Pathfinder VAD, and stereo VAD takes advantage of the two-microphone configuration in a different way, as described below.

Array VAD

The array VAD, described further in the Related Applications, arranges the microphones in a simple linear array and detects the speech using the characteristics of the array. It functions best when the microphones and the user's mouth are linearly co-located and the microphones are located a multiple of a sample distance away. That is, if the sampling frequency of the system is 8 kHz, and the speed of sound is approximately 345 m/s, then in one sample sound will travel $$d=345\text{ m/s}\cdot(1/8000\text{ s})=4.3\text{ cm}$$

and the microphones should be separated by 4.3, 8.6, 12.9 . . . cm. Embodiments of the array VAD in both handsets and headsets are the same as the microphone configurations of FIGS. 8 and 9, described above. Either OMNI or UNI microphones or a combination of the two may be used. If the microphones are to be used for VAD and to capture the acoustic information used for denoising, this configuration uses microphones arranged as in the UNI/UNI microphone array and OMNI/OMNI microphone array described above.

Pathfinder VAD

The Pathfinder VAD, also described further in the Related Applications, uses the gain of the differential transfer function $H_1(z)$ of the Pathfinder technique to determine when voicing is occurring. As such, it can be used with virtually any of the microphone configurations above with little modification. Very good performance has been noted with the UNI/UNI microphone configuration described above with reference to FIG. 7.

Stereo VAD

The stereo VAD, also described further in the Related Applications, uses the difference in frequency amplitude from the noise and the speech to determine when speech is occurring. It uses a microphone configuration in which the SNR is larger in the speech microphone than in the noise microphone. Again, virtually any of the microphone configurations above can be configured to work with this VAD technique, but very good performance has been noted with the UNI/UNI microphone configuration described above with reference to FIG. 7.

Manually Activated VAD

In this embodiment, the user or an outside observer manually activates the VAD, using a pushbutton or switching device. This can even be done offline, on a recording of the data recorded using one of the above configurations. Activation of the manual VAD device, or manually overriding an automatic VAD device like those described above, results in generation of a VAD signal. As this VAD does not rely on the microphones, it may be used with equal utility with any of the microphone configurations above.

Single-Microphone/Conventional VAD

Any conventional acoustic method can also be used with either or both of the speech and noise microphones to construct the VAD signal used by Pathfinder for noise suppression. For example, a conventional mobile phone VAD (see U.S. Pat. No. 6,453,291 of Ashley, where a VAD configuration appropriate to the front-end of a digital cellular system is described) can be used with the speech microphone to construct a VAD signal for use with the Pathfinder noise suppression system. In another embodiment, a "close talk" or gradient microphone may be used to record a high-SNR signal near the mouth, through which a VAD signal may be easily calculated. This microphone could be used as the speech microphone of the system, or could be completely separate. In the case where the gradient microphone is also used as the speech microphone of the system, the gradient microphone takes the place of the UNI microphones in either of the microphone array including mixed OMNI and UNI microphones when the UNI microphone is the speech microphone (described above with reference to FIG. 3) or the microphone array including two UNI microphones when the noise UNI microphone is oriented away from the speaker (described above with reference to FIGS. 6 and 7).

Pathfinder Noise Suppression System

As described above, FIG. 1 is a block diagram of a signal processing system 100 including the Pathfinder noise suppression system 105 and a VAD system 106, under an embodiment. The signal processing system 105 includes two microphones MIC 1 103 and MIC 2 104 that receive signals or information from at least one speech source 101 and at least one noise source 102. The path s(n) from the speech source 101 to MIC 1 and the path n(n) from the noise source 102 to MIC 2 are considered to be unity. Further, $H_1(z)$ represents the path from the noise source 102 to MIC 1, and $H_2(z)$ represents the path from the signal source 101 to MIC 2.

A VAD signal 106, derived in some manner, is used to control the method of noise removal. The acoustic information coming into MIC 1 is denoted by $m_1(n)$. The information coming into MIC 2 is similarly labeled $m_2(n)$. In the z (digital frequency) domain, we can represent them as $M_1(z)$ and $M_2(z)$. Thus $$M_1(z)=S(z)+N(z)H_1(z)$$

$$M_2(z)=N(z)+S(z)H_2(z) \tag{1}$$

This is the general case for all realistic two-microphone systems. There is always some leakage of noise into MIC 1, and some leakage of signal into MIC 2. Equation 1 has four unknowns and only two relationships and, therefore, cannot be solved explicitly.

However, perhaps there is some way to solve for some of the unknowns in Equation 1 by other means. Examine the case where the signal is not being generated, that is, where the VAD indicates voicing is not occurring. In this case, s(n)=S(z)=0, and Equation 1 reduces to $$M_{1n}(z)=N(z)H_1(z)$$

$$M_{2n}(z)=N(z)$$

where the n subscript on the M variables indicate that only noise is being received. This leads to $$M_{1n}(z) = M_{2n}(z)H_1(z) \qquad (2)$$
$$H_1(z) = \frac{M_{1n}(z)}{M_{2n}(z)}.$$

Now, $H_1(z)$ can be calculated using any of the available system identification algorithms and the microphone outputs when only noise is being received. The calculation should be done adaptively in order to allow the system to track any changes in the noise.

After solving for one of the unknowns in Equation 1, $H_2(z)$ can be solved for by using the VAD to determine when voicing is occurring with little noise. When the VAD indicates voicing, but the recent history (on the order of 1 second or so) of the microphones indicate low levels of noise, assume that n(s)=N(z)~0. Then Equation 1 reduces to $$M_{1s}(z) = S(z)$$

$$M_{2s}(z) = S(z)H_2(z)$$

which in turn leads to $$M_{2s}(z) = M_{1s}(z)H_2(z)$$

$$H_2(z) = \frac{M_{2s}(z)}{M_{1s}(z)}$$

This calculation for $H_2(z)$ appears to be just the inverse of the $H_1(z)$ calculation, but remember that different inputs are being used as the calculation now takes place when speech is being produced. Note that $H_2(z)$ should be relatively constant, as there is always just a single source (the user) and the relative position between the user and the microphones should be relatively constant. Use of a small adaptive gain for the $H_2(z)$ calculation works well and makes the calculation more robust in the presence of noise.

Following the calculation of $H_1(z)$ and $H_2(z)$ above, they are used to remove the noise from the signal. Rewriting Equation 1 as $$S(z) = M_1(z) - N(z)H_1(z)$$
$$N(z) = M_2(z) - S(z)H_2(z)$$
$$S(z) = M_1(z) - [M_2(z) - S(z)H_2(z)]H_1(z)$$
$$S(z)[1 - H_2(z)H_1(z)] = M_1(z) - M_2(z)H_1(z)$$

allows solving for S(z)

$$S(z) = \frac{M_1(z) - M_2(z)H_1(z)}{1 - H_2(z)H_1(z)}. \qquad (3)$$

Generally, $H_2(z)$ is quite small, and $H_1(z)$ is less than unity, so for most situations at most frequencies $$H_2(z)H_1(z) \ll 1,$$

and the signal can be calculated using $$S(z) \approx M_1(z) - M_2(z)H_1(z).$$

Therefore the assumption is made that $H_2(z)$ is not needed, and $H_1(z)$ is the only transfer to be calculated. While $H_2(z)$ can be calculated if desired, good microphone placement and orientation can obviate the need for $H_2(z)$ calculation.

Significant noise suppression can only be achieved through the use of multiple subbands in the processing of acoustic signals. This is because most adaptive filters used to calculate transfer functions are of the FIR type, which use only zeros and not poles to calculate a system that contains both zeros and poles as $$H_1(z) \xrightarrow[\text{MODELS}]{} \frac{B(z)}{A(z)}.$$

Such a model can be sufficiently accurate given enough taps, but this can greatly increase computational cost and convergence time. What generally occurs in an energy-based adaptive filter system such as the least-mean squares (LMS) system is that the system matches the magnitude and phase well at a small range of frequencies that contain more energy than other frequencies. This allows the LMS to fulfill its requirement to minimize the energy of the error to the best of its ability, but this fit may cause the noise in areas outside of the matching frequencies to rise, reducing the effectiveness of the noise suppression.

The use of subbands alleviates this problem. The signals from both the primary and secondary microphones are filtered into multiple subbands, and the resulting data from each subband (which can be frequency shifted and decimated if desired, but it is not necessary) is sent to its own adaptive filter. This forces the adaptive filter to try to fit the data in its own subband, rather than just where the energy is highest in the signal. The noise-suppressed results from each subband can be added together to form the final denoised signal at the end. Keeping everything time-aligned and compensating for filter shifts is not easy, but the result is a much better model to the system at the cost of increased memory and processing requirements.

Figure 1B:
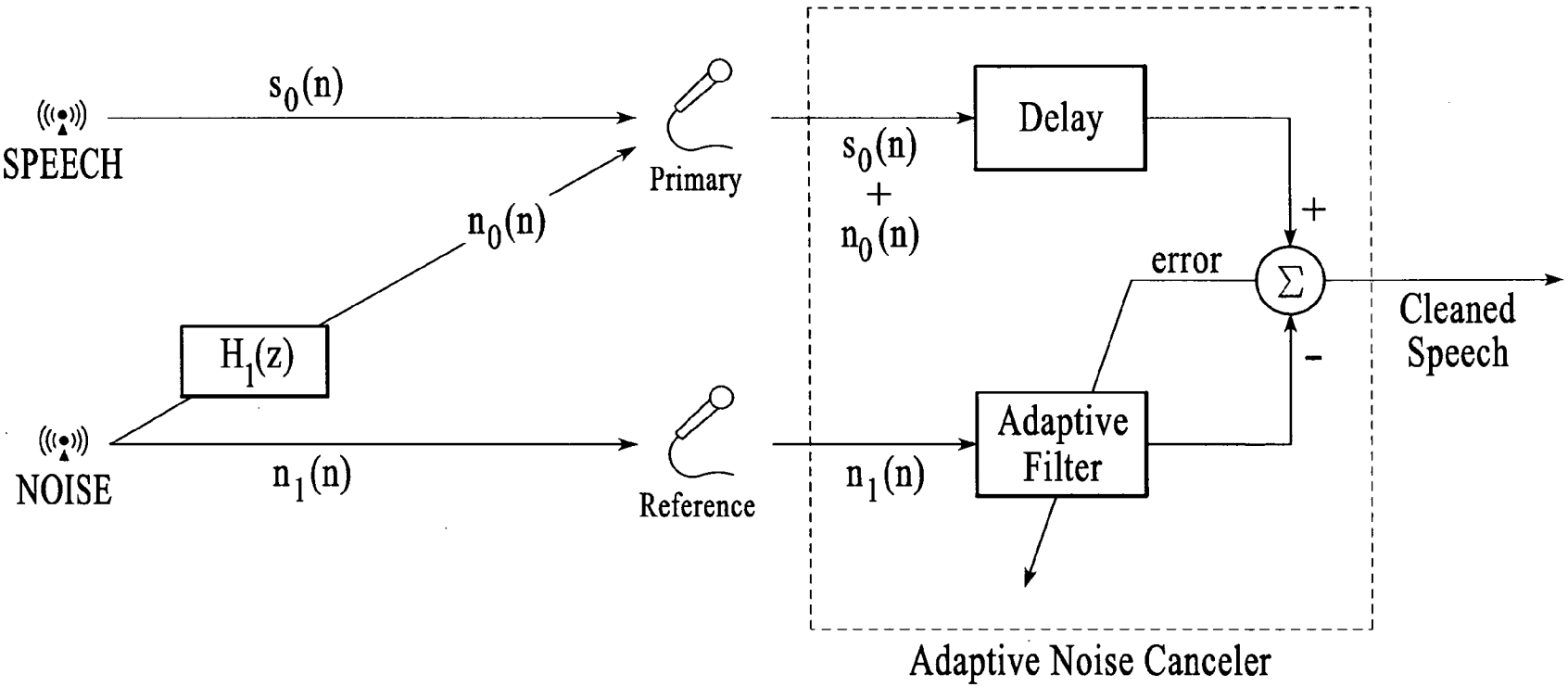
FIG. 1B (PRIOR ART)
FIG. 1B is a block diagram of a conventional adaptive noise cancellation system of the prior art.

At first glance, it may seem as if the Pathfinder algorithm is very similar to other algorithms such as classical ANC (adaptive noise cancellation), shown in FIG. 1B. However, close examination reveals several areas that make all the difference in terms of noise suppression performance, including using VAD information to control adaptation of the noise suppression system to the received signals, using numerous subbands to ensure adequate convergence across the spectrum of interest, and supporting operation with acoustic signal of interest in the reference microphone of the system, as described in turn below.

Regarding the use of VAD to control adaptation of the noise suppression system to the received signals, classical ANC uses no VAD information. Since, during speech production, there is signal in the reference microphone, adapting the coefficients of $H_1(z)$ (the path from the noise to the primary microphone) during the time of speech production would result in the removal of a large part of the speech energy from the signal of interest. The result is signal distortion and reduction (de-signaling). Therefore, the various methods described above use VAD information to construct a sufficiently accurate VAD to instruct the Pathfinder system when to adapt the coefficients of $H_1$ (noise only) and $H_2$ (if needed, when speech is being produced).

An important difference between classical ANC and the Pathfinder system involves subbanding of the acoustic data, as described above. Many subbands are used by the Pathfinder system to support application of the LMS algorithm on information of the subbands individually, thereby ensuring adequate convergence across the spectrum of interest and allowing the Pathfinder system to be effective across the spectrum.

Because the ANC algorithm generally uses the LMS adaptive filter to model $H_1$, and this model uses all zeros to build filters, it was unlikely that a "real" functioning system could be modeled accurately in this way. Functioning systems almost invariably have both poles and zeros, and therefore have very different frequency responses than those of the LMS filter. Often, the best the LMS can do is to match the phase and magnitude of the real system at a single frequency (or a very small range), so that outside this frequency the model fit is very poor and can result in an increase of noise energy in these areas. Therefore, application of the LMS algorithm across the entire spectrum of the acoustic data of interest often results in degradation of the signal of interest at frequencies with a poor magnitude/phase match.

Finally, the Pathfinder algorithm supports operation with the acoustic signal of interest in the reference microphone of the system. Allowing the acoustic signal to be received by the reference microphone means that the microphones can be much more closely positioned relative to each other (on the order of a centimeter) than in classical ANC configurations. This closer spacing simplifies the adaptive filter calculations and enables more compact microphone configurations/solutions. Also, special microphone configurations have been developed that minimize signal distortion and de-signaling, and support modeling of the signal path between the signal source of interest and the reference microphone.

In an embodiment, the use of directional microphones ensures that the transfer function does not approach unity. Even with directional microphones, some signal is received into the noise microphone. If this is ignored and it is assumed that $H_2(z)=0$, then, assuming a perfect VAD, there will be some distortion. This can be seen by referring to Equation 2 and solving for the result when $H_2(z)$ is not included:

$$S(z)[1-H_2(z)H_1(z)]=M_1(z)-M_2(z)H_1(z). \quad (4)$$

This shows that the signal will be distorted by the factor $[1-H_2(z)H_1(z)]$. Therefore, the type and amount of distortion will change depending on the noise environment. With very little noise, $H_1(z)$ is approximately zero and there is very little distortion. With noise present, the amount of distortion may change with the type, location, and intensity of the noise source(s). Good microphone configuration design minimizes these distortions.

The calculation of $H_1$ in each subband is implemented when the VAD indicates that voicing is not occurring or when voicing is occurring but the SNR of the subband is sufficiently low. Conversely, $H_2$ can be calculated in each subband when the VAD indicates that speech is occurring and the subband SNR is sufficiently high. However, with proper microphone placement and processing, signal distortion can be minimized and only $H_1$ need be calculated. This significantly reduces the processing required and simplifies the implementation of the Pathfinder algorithm. Where classical ANC does not allow any signal into MIC 2, the Pathfinder algorithm tolerates signal in MIC 2 when using the appropriate microphone configuration. An embodiment of an appropriate microphone configuration, as described above with reference to FIG. 7A, is one in which two cardioid unidirectional microphones are used, MIC 1 and MIC 2. The configuration orients MIC 1 toward the user's mouth. Further, the configuration places MIC 2 as close to MIC 1 as possible and orients MIC 2 at about 90 degrees with respect to MIC 1.

Perhaps the best way to demonstrate the dependence of the noise suppression on the VAD is to examine the effect of VAD errors on the denoising in the context of a VAD failure. There are two types of errors that can occur. False positives (FP) are when the VAD indicates that voicing has occurred when it has not, and false negatives (FN) are when the VAD does not detect that speech has occurred. False positives are only troublesome if they happen too often, as an occasional FP will only cause the $H_1$ coefficients to stop updating briefly, and experience has shown that this does not appreciably affect the noise suppression performance. False negatives, on the other hand, can cause problems, especially if the SNR of the missed speech is high.

Assuming that there is speech and noise in both microphones of the system, and the system only detects the noise because the VAD failed and returned a false negative, the signal at MIC 2 is $$M_2=H_1N+H_2S,$$

where the z's have been suppressed for clarity. Since the VAD indicates only the presence of noise, the system attempts to model the system above as a single noise and a single transfer function according to $$TF\ \text{model}=\tilde{H}_1\tilde{N}.$$

The Pathfinder system uses an LMS algorithm to calculate $\tilde{H}_1$, but the LMS algorithm is generally best at modeling time-invariant, all-zero systems. Since it is unlikely that the noise and speech signal are correlated, the system generally models either the speech and its associated transfer function or the noise and its associated transfer function, depending on the SNR of the data in MIC 1, the ability to model $H_1$ and $H_2$, and the time-invariance of $H_1$ and $H_2$, as described below.

Regarding the SNR of the data in MIC 1, a very low SNR (less than zero (0)) tends to cause the Pathfinder system to converge to the noise transfer function. In contrast, a high SNR (greater than zero (0)) tends to cause the Pathfinder system converge to the speech transfer function. As for the ability to model $H_1$, if either $H_1$ or $H_2$ is more easily modeled using LMS (an all-zero model), the Pathfinder system tends to converge to that respective transfer function.

In describing the dependence of the system modeling on the time-invariance of $H_1$ and $H_2$, consider that LMS is best at modeling time-invariant systems. Thus, the Pathfinder system would generally tend to converge to $H_2$, since $H_2$ changes much more slowly than $H_1$ is likely to change.

If the LMS models the speech transfer function over the noise transfer function, then the speech is classified as noise and removed as long as the coefficients of the LMS filter remain the same or are similar. Therefore, after the Pathfinder system has converged to a model of the speech transfer function $H_2$ (which can occur on the order of a few milliseconds), any subsequent speech (even speech where the VAD has not failed) has energy removed from it as well as the system "assumes" that this speech is noise because its transfer function is similar to the one modeled when the VAD failed. In this case, where $H_2$ is primarily being modeled, the noise will either be unaffected or only partially removed.

The end result of the process is a reduction in volume and distortion of the cleaned speech, the severity of which is determined by the variables described above. If the system tends to converge to $H_1$, the subsequent gain loss and distortion of the speech will not be significant. If, however, the system tends to converge to $H_2$, then the speech can be severely distorted.

This VAD failure analysis does not attempt to describe the subtleties associated with the use of subbands and the location, type, and orientation of the microphones, but is meant to convey the importance of the VAD to the denoising. The results above are applicable to a single subband or an arbitrary number of subbands, because the interactions in each subband are the same.

In addition, the dependence on the VAD and the problems arising from VAD errors described in the above VAD failure analysis are not limited to the Pathfinder noise suppression system. Any adaptive filter noise suppression system that uses a VAD to determine how to denoise will be similarly affected. In this disclosure, when the Pathfinder noise suppression system is referred to, it should be kept in mind that all noise suppression systems that use multiple microphones to estimate the noise waveform and subtract it from a signal including both speech and noise, and that depend on VAD for reliable operation, are included in that reference. Pathfinder is simply a convenient referenced implementation.

The microphone and VAD configurations described above are for use with communication systems, wherein the communication systems comprise: a voice detection subsystem receiving voice activity signals that include information of human voicing activity and automatically generating control signals using information of the voice activity signals; and a denoising subsystem coupled to the voice detection subsystem, the denoising subsystem including microphones coupled to provide acoustic signals of an environment to components of the denoising subsystem, a configuration of the microphones including two unidirectional microphones separated by a distance and having an angle between maximums of a spatial response curve of each microphone, components of the denoising subsystem automatically selecting at least one denoising method appropriate to data of at least one frequency subband of the acoustic signals using the control signals and processing the acoustic signals using the selected denoising method to generate denoised acoustic signals, wherein the denoising method includes generating a noise waveform estimate associated with noise of the acoustic signals and subtracting the noise waveform estimate from the acoustic signal when the acoustic signal includes speech and noise.

The two unidirectional microphones are separated by a distance approximately in the range of zero (0) to 15 centimeters.

The two unidirectional microphones have an angle between maximums of a spatial response curve of each microphone approximately in the range of zero (0) to 180 degrees.

The voice detection subsystem of an embodiment further comprises at least one glottal electromagnetic micropower sensor (GEMS) including at least one antenna for receiving the voice activity signals, and at least one voice activity detector (VAD) algorithm for processing the GEMS voice activity signals and generating the control signals.

The voice detection subsystem of another embodiment further comprises at least one accelerometer sensor in contact with skin of a user for receiving the voice activity signals, and at least one voice activity detector (VAD) algorithm for processing the accelerometer sensor voice activity signals and generating the control signals.

The voice detection subsystem of yet another embodiment further comprises at least one skin-surface microphone sensor in contact with skin of a user for receiving the voice activity signals, and at least one voice activity detector (VAD) algorithm for processing the skin-surface microphone sensor voice activity signals and generating the control signals.

The voice detection subsystem can also receive voice activity signals via couplings with the microphones.

The voice detection subsystem of still another embodiment further comprises two unidirectional microphones separated by a distance and having an angle between maximums of a spatial response curve of each microphone, wherein the distance is approximately in the range of zero (0) to 15 centimeters and wherein the angle is approximately in the range of zero (0) to 180 degrees, and at least one voice activity detector (VAD) algorithm for processing the voice activity signals and generating the control signals.

The voice detection subsystem of other alternative embodiments further comprises at least one manually activated voice activity detector (VAD) for generating the voice activity signals.

The communications system of an embodiment further includes a portable handset that includes the microphones, wherein the portable handset includes at least one of cellular telephones, satellite telephones, portable telephones, wireline telephones, Internet telephones, wireless transceivers, wireless communication radios, personal digital assistants (PDAs), and personal computers (PCs). The portable handset can include at least one of the voice detection subsystem and the denoising subsystem.

The communications system of an embodiment further includes a portable headset that includes the microphones along with at least one speaker device. The portable headset couples to at least one communication device selected from among cellular telephones, satellite telephones, portable telephones, wireline telephones, Internet telephones, wireless transceivers, wireless communication radios, personal digital assistants (PDAs), and personal computers (PCs). The portable headset couples to the communication device using at least one of wireless couplings, wired couplings, and combination wireless and wired couplings.

The communication device can include at least one of the voice detection subsystem and the denoising subsystem. Alternatively, the portable headset can include at least one of the voice detection subsystem and the denoising subsystem.

The portable headset described above is a portable communication device selected from among cellular telephones, satellite telephones, portable telephones, wireline telephones, Internet telephones, wireless transceivers, wireless communication radios, personal digital assistants (PDAs), and personal computers (PCs).

The microphone and VAD configurations described above are for use with communication systems of alternative embodiments, wherein the communication systems comprise: a voice detection subsystem receiving voice activity signals that include information of human voicing activity and automatically generating control signals using information of the voice activity signals; and a denoising subsystem coupled to the voice detection subsystem, the denoising subsystem including microphones coupled to provide acoustic signals of an environment to components of the denoising subsystem, a configuration of the microphones including an omnidirectional microphone and a unidirectional microphone separated by a distance, components of the denoising subsystem automatically selecting at least one denoising method appropriate to data of at least one frequency subband of the acoustic signals using the control signals and processing the acoustic signals using the selected denoising method to generate denoised acoustic signals, wherein the denoising method includes generating a noise waveform estimate associated with noise of the acoustic signals and subtracting the noise waveform estimate from the acoustic signal when the acoustic signal includes speech and noise.

The omnidirectional and unidirectional microphones are separated by a distance approximately in the range of zero (0) to 15 centimeters.

The omnidirectional microphone is oriented to capture signals from at least one speech signal source and the unidirectional microphone is oriented to capture signals from at least one noise signal source, wherein an angle between the speech signal source and a maximum of a spatial response curve of the unidirectional microphone is approximately in the range of 45 to 180 degrees.

The voice detection subsystem of an embodiment further comprises at least one glottal electromagnetic micropower sensor (GEMS) including at least one antenna for receiving the voice activity signals, and at least one voice activity detector (VAD) algorithm for processing the GEMS voice activity signals and generating the control signals.

The voice detection subsystem of another embodiment further comprises at least one accelerometer sensor in contact with skin of a user for receiving the voice activity signals, and at least one voice activity detector (VAD) algorithm for processing the accelerometer sensor voice activity signals and generating the control signals.

The voice detection subsystem of yet another embodiment further comprises at least one skin-surface microphone sensor in contact with skin of a user for receiving the voice activity signals, and at least one voice activity detector (VAD) algorithm for processing the skin-surface microphone sensor voice activity signals and generating the control signals.

The voice detection subsystem of yet other embodiments further comprises two unidirectional microphones separated by a distance and having an angle between maximums of a spatial response curve of each microphone, wherein the distance is approximately in the range of zero (0) to 15 centimeters and wherein the angle is approximately in the range of zero (0) to 180 degrees, and at least one voice activity detector (VAD) algorithm for processing the voice activity signals and generating the control signals.

The voice detection subsystem can also include at least one manually activated voice activity detector (VAD) for generating the voice activity signals.

The communications system of an embodiment further includes a portable handset that includes the microphones, wherein the portable handset includes at least one of cellular telephones, satellite telephones, portable telephones, wireline telephones, Internet telephones, wireless transceivers, wireless communication radios, personal digital assistants (PDAs), and personal computers (PCs). The portable handset can include at least one of the voice detection subsystem and the denoising subsystem.

The communications system of an embodiment further includes a portable headset that includes the microphones along with at least one speaker device. The portable headset can couples to at least one communication device selected from among cellular telephones, satellite telephones, portable telephones, wireline telephones, Internet telephones, wireless transceivers, wireless communication radios, personal digital assistants (PDAs), and personal computers (PCs). The portable headset couples to the communication device using at least one of wireless couplings, wired couplings, and combination wireless and wired couplings. In one embodiment, the communication device includes at least one of the voice detection subsystem and the denoising subsystem. In an alternative embodiment, the portable headset includes at least one of the voice detection subsystem and the denoising subsystem.

The portable headset described above is a portable communication device selected from among cellular telephones, satellite telephones, portable telephones, wireline telephones, Internet telephones, wireless transceivers, wireless communication radios, personal digital assistants (PDAs), and personal computers (PCs).

The microphone and VAD configurations described above are for use with communication systems comprising: at least one transceiver for use in a communications network; a voice detection subsystem receiving voice activity signals that include information of human voicing activity and automatically generating control signals using information of the voice activity signals; and a denoising subsystem coupled to the voice detection subsystem, the denoising subsystem including microphones coupled to provide acoustic signals of an environment to components of the denoising subsystem, a configuration of the microphones including a first microphone and a second microphone separated by a distance and having an angle between maximums of a spatial response curve of each microphone, components of the denoising subsystem automatically selecting at least one denoising method appropriate to data of at least one frequency subband of the acoustic signals using the control signals and processing the acoustic signals using the selected denoising method to generate denoised acoustic signals, wherein the denoising method includes generating a noise waveform estimate associated with noise of the acoustic signals and subtracting the noise waveform estimate from the acoustic signal when the acoustic signal includes speech and noise.

In an embodiment, each of the first and second microphones is a unidirectional microphone, wherein the distance is approximately in the range of zero (0) to 15 centimeters and the angle is approximately in the range of zero (0) to 180 degrees.

In an embodiment, the first microphone is an omnidirectional microphone and the second microphone is a unidirectional microphone, wherein the first microphone is oriented to capture signals from at least one speech signal source and the second microphone is oriented to capture signals from at least one noise signal source, wherein an angle between the speech signal source and a maximum of a spatial response curve of the second microphone is approximately in the range of 45 to 180 degrees.

The transceiver of an embodiment includes the first and second microphones, but is not so limited.

The transceiver can couple information between the communications network and a user via a headset. The headset used with the transceiver can include the first and second microphones.

Aspects of the invention may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing aspects of the invention include: microcontrollers with memory (such as electronically erasable programmable read only memory (EEPROM)), embedded microprocessors, firmware, software, etc. If aspects of the invention are embodied as software at least one stage during manufacturing (e.g. before being embedded in firmware or in a PLD), the software may be carried by any computer read-able medium, such as magnetically- or optically-readable disks (fixed or floppy), modulated on a carrier signal or otherwise transmitted, etc.

Furthermore, aspects of the invention may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, shall refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of embodiments of the invention are not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. The teachings of the invention provided herein can be applied to other processing systems and communication systems, not only for the communication systems described above.

The elements and acts of the various embodiments described above can be combined to provide further embodiments. These and other changes can be made to the invention in light of the above detailed description.

All of the above references and United States patent applications are incorporated herein by reference. Aspects of the invention can be modified, if necessary, to employ the systems, functions and concepts of the various patents and applications described above to provide yet further embodiments of the invention.

In general, in the following claims, the terms used should not be construed to limit the invention to the specific embodiments disclosed in the specification and the claims, but should be construed to include all processing systems that operate under the claims to provide a method for compressing and decompressing data files or streams. Accordingly, the invention is not limited by the disclosure, but instead the scope of the invention is to be determined entirely by the claims.

While certain aspects of the invention are presented below in certain claim forms, the inventors contemplate the various aspects of the invention in any number of claim forms. For example, while only one aspect of the invention is recited as embodied in a computer-readable medium, other aspects may likewise be embodied in a computer-readable medium. Accordingly, the inventors reserve the right to add additional claims after filing the application to pursue such additional claim forms for other aspects of the invention.

What we claim is:

1. A communications system, comprising:

a voice detection subsystem configured to receive voice activity signals that includes information associated with human voicing activity, the voice detection subsystem configured to automatically generate control signals using the voice activity signals; and a denoising subsystem coupled to the voice detection subsystem, the denoising subsystem comprising a microphone array including a plurality of microphones, wherein a first microphone of the array is fixed at a first position relative to a mouth, wherein the first position orients a front of the first microphone towards the mouth, wherein a second microphone of the array is fixed at a second position relative to the mouth, wherein the second position orients a front of the second microphone away from the mouth such that the second position forms an angle relative to the first position, wherein the angle is greater than zero degrees, the microphone array providing acoustic signals of an environment to components of the denoising subsystem, components of the denoising subsystem automatically selecting at least one denoising method appropriate to data of at least one frequency subband of the acoustic signals using the control signals and processing the acoustic signals using the selected denoising method to generate denoised acoustic signals, wherein the denoising method includes generating a noise waveform estimate associated with noise of the acoustic signals and subtracting the noise waveform estimate from the acoustic signal when the acoustic signal includes speech and noise, wherein the voice detection subsystem is configured to receive the voice activity signals using a sensor independent from the microphone array and to output the control signals generated from the voice activity signals to the denoising system, the denoising system configured to use the control signals to denoise the acoustic signals from the microphone array.

2. The system of claim 1, wherein the voice detection subsystem further comprises:

at least one glottal electromagnetic micropower sensor (GEMS) including at least one antenna for receiving the voice activity signals; and at least one voice activity detector (VAD) algorithm for processing the GEMS voice activity signals and generating the control signals.

3. The system of claim 1, wherein the voice detection subsystem further comprises:

at least one accelerometer sensor in contact with skin for receiving the voice activity signals; and at least one voice activity detector (VAD) algorithm for processing the accelerometer sensor voice activity signals and generating the control signals.

4. The system of claim 1, wherein the voice detection subsystem further comprises:

at least one skin-surface microphone sensor in contact with skin for receiving the voice activity signals; and at least one voice activity detector (VAD) algorithm for processing the skin-surface microphone sensor voice activity signals and generating the control signals.

5. The system of claim 1, wherein the voice detection subsystem further comprises at least one manually activated voice activity detector (VAD) for generating the voice activity signals.

6. The system of claim 1, further including a portable handset that includes the microphones, wherein the portable handset includes at least one of cellular telephones, satellite telephones, portable telephones, wireline telephones, Internet telephones, wireless transceivers, wireless communication radios, personal digital assistants (PDAs), and personal computers (PCs).

7. The system of claim 6, wherein the portable handset includes at least one of the voice detection subsystem and the denoising subsystem.

8. The system of claim 1, further including a portable headset that includes the microphones along with at least one speaker device.

9. The system of claim 8, wherein the portable headset couples to at least one communication device selected from among cellular telephones, satellite telephones, portable telephones, wireline telephones, Internet telephones, wireless transceivers, wireless communication radios, personal digital assistants (PDAs), and personal computers (PCs).

10. The system of claim 9, wherein the portable headset couples to the communication device using at least one of wireless couplings, wired couplings, and combination wireless and wired couplings.

11. The system of claim 9, wherein the communication device includes at least one of the voice detection subsystem and the denoising subsystem.

12. The system of claim 8, wherein the portable headset includes at least one of the voice detection subsystem and the denoising subsystem.

13. The system of claim 8, wherein the portable headset is a portable communication device selected from among cellular telephones, satellite telephones, portable telephones, wireline telephones, Internet telephones, wireless transceivers, wireless communication radios, personal digital assistants (PDAs), and personal computers (PCs).

14. The system of claim 1, wherein the first microphone is a unidirectional microphone and the second microphone is a unidirectional microphone.

15. The system of claim 14, wherein the first microphone and the second microphone are separated by a distance in a range of approximately zero (0) centimeters to 15 centimeters.

16. The system of claim 14, wherein the angle is in a range of approximately greater than zero (0) degrees and one of equal to and less than 180 degrees.

17. The system of claim 14, wherein the angle is in a range of approximately greater than zero (0) degrees and one of equal to and less than 135 degrees.

18. The system of claim 14, wherein the angle is in a range of approximately greater than zero (0) degrees and one of equal to and greater than 90 degrees.

19. The system of claim 1, wherein the first microphone is an omnidirectional microphone and the second microphone is a unidirectional microphone.

20. The system of claim 19, wherein the first microphone and the second microphone are separated by a distance approximately in a range of zero (0) centimeters to 15 centimeters.

21. The system of claim 19, wherein the angle is approximately in a range of 30 degrees to 180 degrees.

22. The system of claim 19, wherein the angle is approximately in a range of 60 degrees to 180 degrees.

23. The system of claim 19, wherein the angle is approximately in a range of 90 degrees to 180 degrees.

24. The system of claim 1, wherein the first microphone is a unidirectional microphone and the second microphone is an omnidirectional microphone.

25. The system of claim 24, wherein the first microphone and the second microphone are separated by a distance approximately in a range of zero (0) centimeters to 15 centimeters.

26. A communications system, comprising:

a voice detection subsystem configured to receive voice activity signals that include information associated with human voicing activity, the voice detection subsystem configured to automatically generate control signals using the voice activity signals;

a denoising subsystem coupled to the voice detection subsystem, the denoising subsystem comprising a microphone array including a plurality of microphones, wherein a first microphone of the array is fixed at a first position relative to a mouth, wherein the first position orients a front of the first microphone towards the mouth, wherein a second microphone of the array is fixed at a second position relative to the mouth, wherein the second position orients a front of the second microphone away from the mouth such that the second position forms an angle relative to the first position, wherein the angle is greater than zero degrees, the microphone array providing acoustic signals of an environment to components of the denoising subsystem, components of the denoising subsystem automatically selecting at least one denoising method appropriate to data of at least one frequency subband of the acoustic signals using the control signals and processing the acoustic signals using the selected denoising method to generate denoised acoustic signals, wherein the denoising method includes generating a noise waveform estimate associated with noise of the acoustic signals and subtracting the noise waveform estimate from the acoustic signal when the acoustic signal includes speech and noise, wherein the voice detection subsystem is configured to receive the voice activity signals using a sensor independent from the microphone array and to output the control signals generated from the voice activity signals to the denoising system, the denoising system configured to use the control signals to denoise the acoustic signals from the microphone array; and a portable headset comprising the plurality of microphones and at least one speaker device, wherein the portable headset couples to at least one communication device selected from among cellular telephones, satellite telephones, portable telephones, wireline telephones, Internet telephones, wireless transceivers, wireless communication radios, personal digital assistants (PDAs), personal computers (PCs), and at least one of the voice detection subsystem and the denoising subsystem.

* * * * *